US009564696B2

(12) United States Patent
Gulla

(10) Patent No.: US 9,564,696 B2
(45) Date of Patent: Feb. 7, 2017

(54) ELECTRICAL CONNECTOR ASSEMBLY

(71) Applicant: Amphenol Corporation, Wallingford Center, CT (US)

(72) Inventor: Joseph M. Gulla, Nashua, NH (US)

(73) Assignee: Amphenol Corporation, Wallingford Center, CT (US)

( * ) Notice: Subject to any disclaimer, the term of this patent is extended or adjusted under 35 U.S.C. 154(b) by 0 days.

(21) Appl. No.: 14/264,028

(22) Filed: Apr. 28, 2014

(65) Prior Publication Data

US 2014/0308852 A1 Oct. 16, 2014

Related U.S. Application Data

(63) Continuation of application No. 13/898,231, filed on May 20, 2013, now Pat. No. 8,727,791, which is a (Continued)

(51) Int. Cl.
*H01R 12/00* (2006.01)
*H01R 9/24* (2006.01)
(Continued)

(52) U.S. Cl.
CPC ..... *H01R 9/2491* (2013.01); *H01R 12/70* (2013.01); *H01R 12/91* (2013.01); *H01R 13/516* (2013.01);
(Continued)

(58) Field of Classification Search
CPC ..... H01R 9/2491; H01R 12/70; H01R 13/516; H01R 43/18; H01R 12/91; H01R 13/6453; H01R 12/737; H01R 13/6587; H01R 12/58; Y10T 29/49208
(Continued)

(56) References Cited

U.S. PATENT DOCUMENTS 2,539,230 A 1/1951 Gordon
3,262,082 A 7/1966 Gammel, Sr.
(Continued)

FOREIGN PATENT DOCUMENTS

CN 2519434 Y 10/2002
CN 101124697 A 2/2008
(Continued)

OTHER PUBLICATIONS

Search Report and Written Opinion mailed Oct. 16, 2008 from International Application No. PCT/US2007/026056.
(Continued)

*Primary Examiner* — Jean F Duverne
(74) *Attorney, Agent, or Firm* — Wolf, Greenfield & Sacks, P.C.

(57) ABSTRACT

Electrical connectors for interconnecting circuit boards. One such connector includes an integral flange for mounting a guidance pin in any of multiple orientations. A corresponding keying block may have a polarization component that can be mounted in a corresponding number of positions. The connector can accept conductive elements with different shapes for signals and grounds, but the housing may be adapted to receive either type of contact in any contact location. Protection of contact elements from excessive yield is provided within the insulative housing of the backplane connector. On the daughter card connector, height difference between ground and signal contacts in wafer assemblies protects components from electrostatic discharge.

20 Claims, 41 Drawing Sheets

Related U.S. Application Data continuation of application No. 12/863,270, filed as application No. PCT/US2009/000316 on Jan. 16, 2009, now Pat. No. 8,469,720.

(60) Provisional application No. 61/021,841, filed on Jan. 17, 2008.

(51) Int. Cl.

| | |
|---|---|
| ***H01R 12/91*** | (2011.01) |
| ***H01R 13/645*** | (2006.01) |
| ***H01R 13/516*** | (2006.01) |
| ***H01R 43/18*** | (2006.01) |
| ***H01R 12/70*** | (2011.01) |
| *H01R 12/73* | (2011.01) |
| *H01R 13/6587* | (2011.01) |

(52) U.S. Cl.
CPC ..... *H01R 13/6453* (2013.01); *H01R 43/18* (2013.01); *H01R 12/737* (2013.01); *H01R 13/6587* (2013.01); *Y10T 29/49208* (2015.01)

(58) Field of Classification Search
USPC ..... 439/65
See application file for complete search history.

(56) References Cited

U.S. PATENT DOCUMENTS

| | | | | |
|---|---|---|---|---|
| 3,582,867 | A | | 6/1971 | Thompson et al. |
| 3,601,774 | A | | 8/1971 | Stathos et al. |
| 4,002,400 | A | | 1/1977 | Evans |
| 4,036,544 | A | | 7/1977 | Keglewitsch |
| 4,052,688 | A | | 10/1977 | DeNigris et al. |
| 4,175,821 | A | | 11/1979 | Hunter |
| 4,420,215 | A | | 12/1983 | Tengler |
| 4,519,665 | A | | 5/1985 | Althouse et al. |
| 4,519,667 | A | | 5/1985 | Canning et al. |
| 4,607,907 | A | | 8/1986 | Bogursky |
| 4,632,476 | A | | 12/1986 | Schell |
| 4,786,258 | A | | 11/1988 | Shaffer et al. |
| 4,790,763 | A | | 12/1988 | Weber et al. |
| 4,795,379 | A | | 1/1989 | Sasaki et al. |
| 4,806,107 | A | | 2/1989 | Arnold et al. |
| 4,812,133 | A | | 3/1989 | Fleak et al. |
| 4,820,169 | A | | 4/1989 | Weber et al. |
| 4,826,443 | A | * | 5/1989 | Lockard ..... 439/101 |
| 4,846,727 | A | * | 7/1989 | Glover et al. ..... 439/607.07 |
| 4,867,597 | A | | 9/1989 | Denlinger et al. |
| 4,871,316 | A | | 10/1989 | Herrell et al. |
| 4,895,535 | A | | 1/1990 | Emadi et al. |
| 4,932,885 | A | | 6/1990 | Scholz |
| 4,934,950 | A | | 6/1990 | Green et al. |
| 4,975,084 | A | | 12/1990 | Fedder et al. |
| 5,009,606 | A | | 4/1991 | Villeneuve et al. |
| 5,024,605 | A | | 6/1991 | Kasatani et al. |
| 5,041,023 | A | | 8/1991 | Lytle |
| 5,051,099 | A | | 9/1991 | Pickles et al. |
| 5,062,809 | A | | 11/1991 | Sakamoto et al. |
| 5,066,236 | A | | 11/1991 | Broeksteeg |
| 5,080,613 | A | | 1/1992 | Orui et al. |
| 5,096,443 | A | | 3/1992 | Myrick et al. |
| 5,173,063 | A | | 12/1992 | Barkus et al. |
| 5,176,538 | A | | 1/1993 | Hansell, III et al. |
| 5,199,884 | A | | 4/1993 | Kaufman et al. |
| 5,211,585 | A | | 5/1993 | Douty et al. |
| 5,219,301 | A | | 6/1993 | Frantz |
| 5,334,050 | A | | 8/1994 | Andrews |
| 5,346,410 | A | | 9/1994 | Moore, Jr. |
| 5,370,557 | A | | 12/1994 | Olsson |
| 5,429,520 | A | | 7/1995 | Morlion et al. |
| 5,429,521 | A | | 7/1995 | Morlion et al. |
| 5,433,617 | A | | 7/1995 | Morlion et al. |
| 5,433,618 | A | | 7/1995 | Morlion et al. |
| 5,484,310 | A | | 1/1996 | McNamara et al. |
| 5,496,183 | A | | 3/1996 | Soes et al. |
| 5,645,459 | A | | 7/1997 | Fitting |
| 5,702,258 | A | | 12/1997 | Provencher et al. |
| 5,743,765 | A | | 4/1998 | Andrews et al. |
| 5,919,049 | A | | 7/1999 | Petersen et al. |
| 5,993,259 | A | | 11/1999 | Stokoe et al. |
| 6,024,579 | A | | 2/2000 | Bennett |
| 6,059,600 | A | | 5/2000 | Vanbesien |
| 6,109,949 | A | | 8/2000 | Suzuki et al. |
| 6,116,926 | A | * | 9/2000 | Ortega ..... H01R 13/6471 439/108 |
| 6,146,202 | A | | 11/2000 | Ramey et al. |
| 6,171,115 | B1 | | 1/2001 | Mickievicz et al. |
| 6,174,944 | B1 | | 1/2001 | Chiba et al. |
| 6,293,827 | B1 | | 9/2001 | Stokoe |
| 6,299,438 | B1 | | 10/2001 | Sahagian et al. |
| 6,315,591 | B2 | | 11/2001 | Oda et al. |
| 6,315,615 | B1 | | 11/2001 | Raistrick |
| 6,315,621 | B1 | | 11/2001 | Natori et al. |
| 6,347,962 | B1 | | 2/2002 | Kline |
| 6,350,134 | B1 | | 2/2002 | Fogg et al. |
| 6,379,188 | B1 | | 4/2002 | Cohen et al. |
| 6,409,543 | B1 | | 6/2002 | Astbury, Jr. et al. |
| 6,454,603 | B2 | | 9/2002 | Casey et al. |
| 6,503,103 | B1 | | 1/2003 | Cohen et al. |
| 6,506,076 | B2 | | 1/2003 | Cohen et al. |
| 6,540,526 | B2 | | 4/2003 | Toda |
| 6,540,559 | B1 | | 4/2003 | Kemmick et al. |
| 6,551,140 | B2 | | 4/2003 | Billman et al. |
| 6,554,647 | B1 | | 4/2003 | Cohen et al. |
| 6,565,387 | B2 | | 5/2003 | Cohen |
| 6,592,381 | B2 | | 7/2003 | Cohen et al. |
| 6,602,095 | B2 | | 8/2003 | Astbury, Jr. et al. |
| 6,607,402 | B2 | | 8/2003 | Cohen et al. |
| 6,641,420 | B2 | | 11/2003 | Blanchfield et al. |
| 6,645,012 | B2 | | 11/2003 | Ito et al. |
| 6,652,319 | B1 | | 11/2003 | Billman |
| 6,655,966 | B2 | | 12/2003 | Rothermel et al. |
| 6,709,294 | B1 | | 3/2004 | Cohen et al. |
| 6,764,349 | B2 | | 7/2004 | Provencher et al. |
| 6,776,659 | B1 | | 8/2004 | Stokoe et al. |
| 6,786,771 | B2 | | 9/2004 | Gailus |
| 6,808,420 | B2 | | 10/2004 | Whiteman, Jr. et al. |
| 6,811,440 | B1 | | 11/2004 | Rothermel et al. |
| 6,824,391 | B2 | | 11/2004 | Mickievicz et al. |
| 6,827,611 | B1 | | 12/2004 | Payne et al. |
| 6,866,549 | B2 | | 3/2005 | Kimura et al. |
| 6,872,085 | B1 | | 3/2005 | Cohen et al. |
| 6,875,031 | B1 | | 4/2005 | Korsunsky et al. |
| 6,899,548 | B2 | | 5/2005 | Houtz |
| 6,932,649 | B1 | | 8/2005 | Rothermel et al. |
| 6,942,509 | B2 | | 9/2005 | Sasame et al. |
| 6,945,810 | B1 | | 9/2005 | Morana et al. |
| 6,979,202 | B2 | | 12/2005 | Benham et al. |
| 7,008,250 | B2 | | 3/2006 | Shuey et al. |
| 7,044,794 | B2 | | 5/2006 | Consoli et al. |
| 7,163,421 | B1 | | 1/2007 | Cohen et al. |
| 7,175,445 | B2 | | 2/2007 | Consoli et al. |
| 7,182,616 | B2 | | 2/2007 | Shuey et al. |
| 7,186,121 | B1 | | 3/2007 | Costello et al. |
| 7,316,585 | B2 | | 1/2008 | Smith et al. |
| 7,326,092 | B2 | | 2/2008 | Fedder et al. |
| 7,331,830 | B2 | | 2/2008 | Minich |
| 7,335,063 | B2 | | 2/2008 | Cohen et al. |
| 7,354,274 | B2 | | 4/2008 | Minich |
| 7,371,117 | B2 | | 5/2008 | Gailus |
| 7,422,483 | B2 | | 9/2008 | Avery et al. |
| 7,494,383 | B2 | | 2/2009 | Cohen et al. |
| 7,503,804 | B2 | | 3/2009 | Minich |
| 7,517,250 | B2 | | 4/2009 | Hull et al. |
| 7,544,096 | B2 | | 6/2009 | Cohen et al. |
| 7,581,990 | B2 | | 9/2009 | Kirk et al. |
| 7,722,401 | B2 | | 5/2010 | Kirk et al. |
| 7,775,822 | B2 | | 8/2010 | Ngo et al. |
| 7,789,676 | B2 | | 9/2010 | Morgan et al. |
| 7,794,278 | B2 | | 9/2010 | Cohen et al. |
| 7,811,130 | B2 | | 10/2010 | Cohen et al. |
| 7,874,873 | B2 | | 1/2011 | Do et al. |
| 7,914,304 | B2 | | 3/2011 | Cartier et al. |

(56) References Cited

U.S. PATENT DOCUMENTS

| | | | | |
|---|---|---|---|---|
| 7,950,963 | B2 | 5/2011 | Mizukami et al. | |
| 7,985,097 | B2 | 7/2011 | Gulla | |
| 8,057,267 | B2 | 11/2011 | Johnescu | |
| 8,062,046 | B2 | 11/2011 | Daily et al. | |
| 8,251,745 | B2 | 8/2012 | Johnescu et al. | |
| 8,469,720 | B2 | 6/2013 | Gulla | |
| 8,469,745 | B2 | 6/2013 | Davis et al. | |
| 8,550,861 | B2 | 10/2013 | Cohen et al. | |
| 8,678,860 | B2 | 3/2014 | Minich et al. | |
| 8,727,791 | B2 | 5/2014 | Gulla | |
| 9,017,114 | B2 | 4/2015 | Cohen et al. | |
| 9,190,745 | B2 | 11/2015 | Gulla | |
| 2001/0012730 | A1 | 8/2001 | Ramey et al. | |
| 2001/0044235 | A1 | 11/2001 | Cohen | |
| 2001/0046810 | A1 | 11/2001 | Cohen et al. | |
| 2002/0098738 | A1 | 7/2002 | Astbury et al. | |
| 2002/0111069 | A1 | 8/2002 | Astbury et al. | |
| 2002/0123266 | A1 | 9/2002 | Ramey et al. | |
| 2002/0142675 | A1 | 10/2002 | Billman | |
| 2003/0119362 | A1* | 6/2003 | Nelson | H01R 13/518 439/607.07 |
| 2003/0220018 | A1 | 11/2003 | Winings et al. | |
| 2004/0005815 | A1 | 1/2004 | Mizumura et al. | |
| 2004/0171305 | A1 | 9/2004 | McGowan et al. | |
| 2004/0224559 | A1* | 11/2004 | Nelson | H01R 13/514 439/607.05 |
| 2004/0235352 | A1 | 11/2004 | Takemasa | |
| 2005/0048838 | A1 | 3/2005 | Korsunsky et al. | |
| 2005/0048842 | A1 | 3/2005 | Benham et al. | |
| 2005/0176835 | A1 | 8/2005 | Kobayashi et al. | |
| 2005/0233610 | A1 | 10/2005 | Tutt et al. | |
| 2005/0266728 | A1 | 12/2005 | Houtz | |
| 2006/0003620 | A1 | 1/2006 | Daily et al. | |
| 2006/0068640 | A1 | 3/2006 | Gailus | |
| 2006/0128203 | A1 | 6/2006 | Yosler | |
| 2006/0292932 | A1 | 12/2006 | Benham et al. | |
| 2007/0004282 | A1 | 1/2007 | Cohen et al. | |
| 2007/0021000 | A1 | 1/2007 | Laurx | |
| 2007/0021001 | A1 | 1/2007 | Laurx et al. | |
| 2007/0021002 | A1* | 1/2007 | Laurx et al. | 439/608 |
| 2007/0021003 | A1 | 1/2007 | Laurx et al. | |
| 2007/0021004 | A1 | 1/2007 | Laurx et al. | |
| 2007/0037434 | A1 | 2/2007 | Fedder et al. | |
| 2007/0042639 | A1 | 2/2007 | Manter et al. | |
| 2008/0194146 | A1 | 8/2008 | Gailus | |
| 2008/0214055 | A1 | 9/2008 | Gulla | |
| 2008/0246555 | A1 | 10/2008 | Kirk et al. | |
| 2008/0248658 | A1 | 10/2008 | Cohen et al. | |
| 2008/0248659 | A1 | 10/2008 | Cohen et al. | |
| 2009/0011641 | A1 | 1/2009 | Cohen et al. | |
| 2009/0239395 | A1 | 9/2009 | Cohen et al. | |
| 2009/0305533 | A1 | 12/2009 | Feldman et al. | |
| 2010/0291806 | A1 | 11/2010 | Minich et al. | |
| 2011/0130038 | A1 | 6/2011 | Cohen et al. | |
| 2011/0230096 | A1 | 9/2011 | Atkinson et al. | |
| 2012/0214344 | A1 | 8/2012 | Cohen et al. | |
| 2013/0109232 | A1 | 5/2013 | Paniaqua | |
| 2013/0143442 | A1 | 6/2013 | Cohen et al. | |
| 2013/0210246 | A1 | 8/2013 | Davis et al. | |
| 2013/0288521 | A1 | 10/2013 | McClellan et al. | |
| 2013/0288525 | A1 | 10/2013 | McClellan et al. | |
| 2013/0288539 | A1 | 10/2013 | McClellan et al. | |
| 2014/0065883 | A1 | 3/2014 | Cohen et al. | |
| 2014/0322985 | A1 | 10/2014 | Gulla | |
| 2014/0329414 | A1 | 11/2014 | Cohen et al. | |
| 2015/0236451 | A1 | 8/2015 | Cartier, Jr. et al. | |
| 2015/0236452 | A1 | 8/2015 | Cartier, Jr. et al. | |
| 2015/0280351 | A1 | 10/2015 | Bertsch | |
| 2016/0141807 | A1 | 5/2016 | Gailus et al. | |

FOREIGN PATENT DOCUMENTS

| | | | |
|---|---|---|---|
| EP | 1 427 061 | A2 | 6/2004 |
| WO | WO 01/57961 | A1 | 8/2001 |
| WO | WO 2008/124052 | A2 | 10/2008 |
| WO | WO 2008/124054 | A2 | 10/2008 |
| WO | WO 2008/124057 | A2 | 10/2008 |
| WO | WO 2008/124101 | A2 | 10/2008 |

OTHER PUBLICATIONS

Written Opinion of the International Searching Authority mailed Jul. 2, 2009 from International Application No. PCT/US2007/026056.

Search Report and Written Opinion mailed Jul. 14, 2009 from International Application No. PCT/US2009/000316.

International Search Report and Written Opinion for International Application No. PCT/US2010/002452 mailed Mar. 29, 2011.

[No Author Listed] High Speed Backplane Connectors, Z-Pack-HM-Zd Connector, Catalog 1773095, retrieved from <www.tycoelectronics.com>, Rev. Dec. 2008, pp. 56-94.

International Preliminary Report on Patentability for International Application No. PCT/US2010/002452 mailed Mar. 22, 2012.

International Search Report and Written Opinion mailed May 13, 2015 for Application No. PCT/US2015/012463.

International Search Report and Written Opinion mailed Mar. 11, 2016 for Application No. PCT/US2015/060472.

International Search Report and Written Opinion mailed Apr. 30, 2015 for Application No. PCT/US2015/012542.

U.S. Appl. No. 14/332,125, filed Jul. 15, 2014, Cohen et al.

U.S. Appl. No. 14/326,927, filed Jul. 9, 2014, Gulla.

PCT/US2010/002452, Mar. 22, 2012, International Preliminary Report on Patentability.

* cited by examiner

ELECTRICAL CONNECTOR ASSEMBLY

RELATED APPLICATIONS

This application is a continuation of U.S. patent application Ser. No. 13/898,231 filed May 20, 2013, entitled "ELECTRICAL CONNECTOR ASSEMBLY" which was a continuation of U.S. patent application Ser. No. 12/863,270 filed Feb. 14, 2011, entitled "ELECTRICAL CONNECTOR ASSEMBLY" which was a national stage filing under 35 U.S.C. §371 of international PCT application PCT/US2009/000316, filed Jan. 16, 2009, entitled "ELECTRICAL CONNECTOR ASSEMBLY" which claims priority to U.S. Provisional Application No. 61/021,841 filed Jan. 17, 2008, entitled "ELECTRICAL CONNECTOR ASSEMBLY," the contents of each of which is incorporated herein by reference in its entirety.

BACKGROUND OF INVENTION

1. Field of Invention

The present invention relates generally to electronic assemblies and more specifically to electrical connectors for interconnecting circuit boards.

2. Discussion of Related Art

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Additionally, electrical connectors are used to make connections between other components of electronic assemblies. For example, electrical connectors may be used to connect daughter cards containing circuitry to motherboards, to connect extension boards to printed circuit boards, to connect cables to printed circuit boards or to connect chips to printed circuit boards.

Conventional circuit board electrical connectors are disclosed in the U.S. Pat. No. 6,824,391 to Mickievicz et al., U.S. Pat. No. 6,811,440 to Rothermel et al., U.S. Pat. No. 6,655,966 to Rothermel et al., U.S. Pat. No. 6,267,604 to Mickievicz et al., and U.S. Pat. No. 6,171,115 to Mickievicz et al., the subject matter of each of which is incorporated by reference.

Other examples of electrical connectors are shown in U.S. Pat. No. 6,293,827, U.S. Pat. No. 6,503,103 and U.S. Pat. No. 6,776,659, all of which are hereby incorporated by reference in their entireties.

SUMMARY OF INVENTION

In one aspect the invention relates to an interface for electrically connecting a first printed circuit board with a second printed circuit board. The interface includes an insulative housing includes a flange. The flange includes a keying interface having a keying profile. The housing also has a plurality of conductive contact positions, and a guidance pin. The guidance pin has a mating portion adapted to engage a complementary shaped mating portion of a mating connector. The guidance pin also has an attachment portion shaped to complement the keying profile such that the attachment portion may be inserted into the keying interface. The mating portion has a predefined position and orientation relative to the plurality of conductive contact positions when the attachment portion is inserted into the keying interface.

In another aspect, the invention relates to a guidance block adapted for use in conjunction with a connector mounted to a first printed circuit board to electrically connect the first printed circuit board with a second printed circuit board. The guidance block includes a member having a first opening shaped to receive a guidance pin in a first relative orientation of the member and the guidance pin and to limit insertion of the guidance pin into the first opening in at least a second relative orientation. The guidance block includes a housing with an opening having an inner profile shaped to receive the guidance pin and at least one retention feature adjacent to the opening. The retention feature is adapted and configured to restrain the member in each of a plurality of orientations.

In a further aspect, the invention relates to a connection interface between a first printed circuit board and a second printed circuit board. The connection interface includes a guidance block and a guidance pin. The guidance block has an inner profile and the guidance pin has a shaft portion with a profile allowing for insertion of the guidance pin into the guidance block. Upon insertion of the guidance pin into the guidance block, movement of the guidance pin is substantially constrained in a first direction, perpendicular to the shaft portion, and allowed in a second direction perpendicular to the shaft that is transverse to the first direction.

In yet another aspect, the invention relates to a housing for an electrical connector with a plurality of mating regions, each facing a mating connector when the electrical connector is mated with the mating connector is provided. Each mating region includes an inside wall disposed between the mating region and an adjacent mating region and a guiding portion for guiding a mating contact into the mating region such that the mating contact forms a connection with a conductive contact disposed within the mating region. Each mating region has a protective edge disposed beneath the guiding portion under which the conductive contact is disposed. The inside walls provides a stop mechanism for excessive yielding of a conductive contact in the mating region.

In a further aspect, the invention relates to an electrical contact assembly. The electrical contact assembly includes a housing and a plurality of signal contacts disposed within the housing. The signal contacts have a signal contact height. A plurality of ground contacts are disposed within the housing in close proximity to the signal contacts. The ground contacts having an average on-center spacing from the signal contacts and having a ground contact height that is greater than the signal contact height, defining a height difference. A ratio between the height difference and the average on-center spacing between ground contacts and signal contacts is between approximately 0.5 and 2.

In another aspect, the invention relates to an electrical contact assembly. The electrical assembly includes a plurality of signal contacts and a plurality of ground contacts. The signal contacts have a signal orientation, and the ground contacts have a ground orientation. The assembly includes an insulative housing having a plurality of attachment regions. Each attachment region is adapted to accept either a signal contact or a ground contact, and the signal contacts and ground contacts may be positioned in the insulative housing in a programmed pattern.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
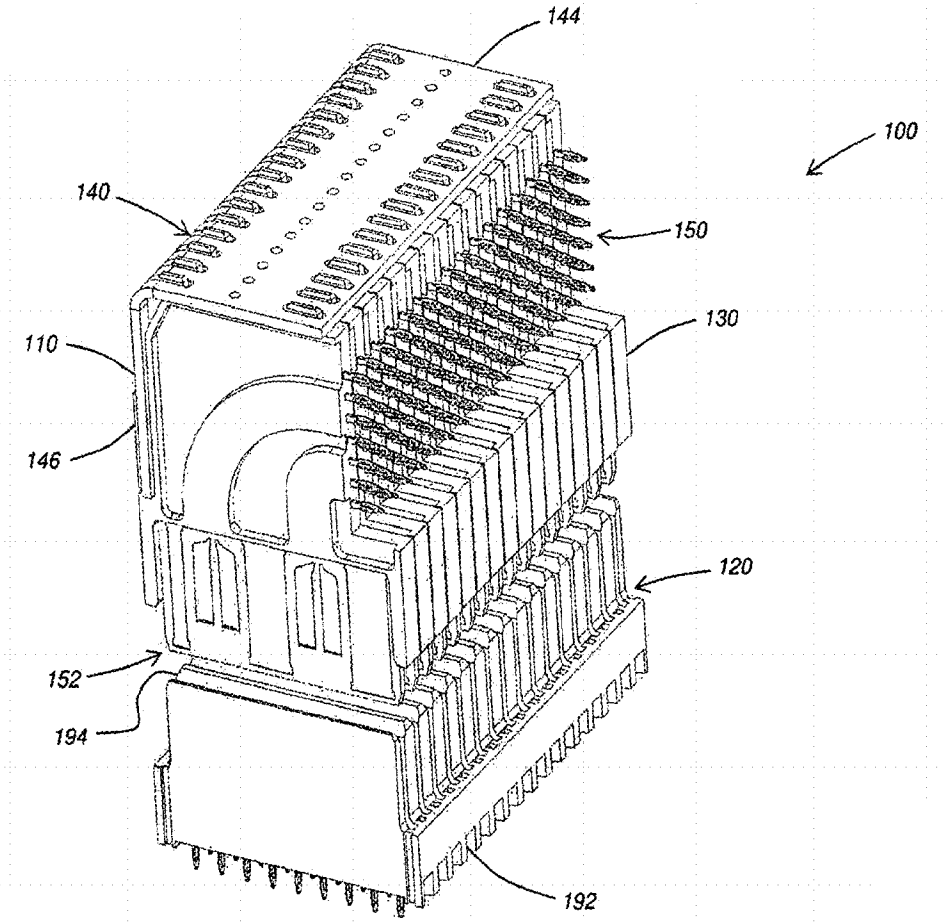
FIGS. 1A-1C illustrate one exemplary embodiment of a connector assembly in accordance with the present invention.
Figure 1B:
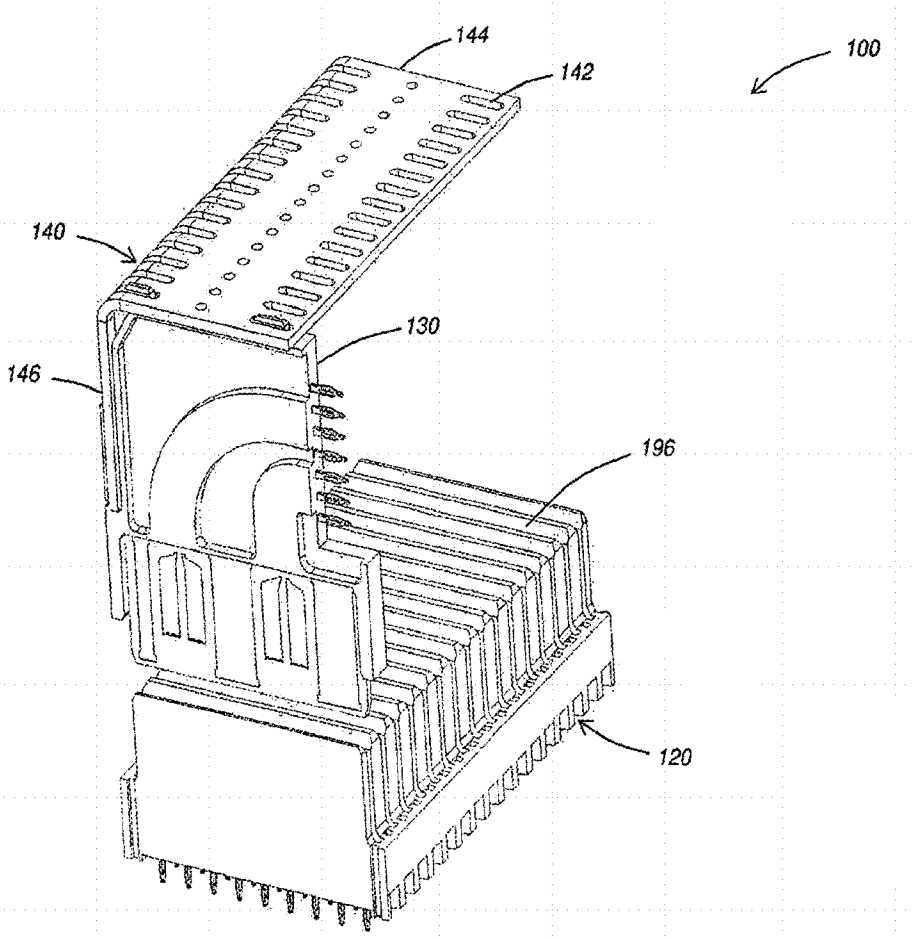
Figure 1C:
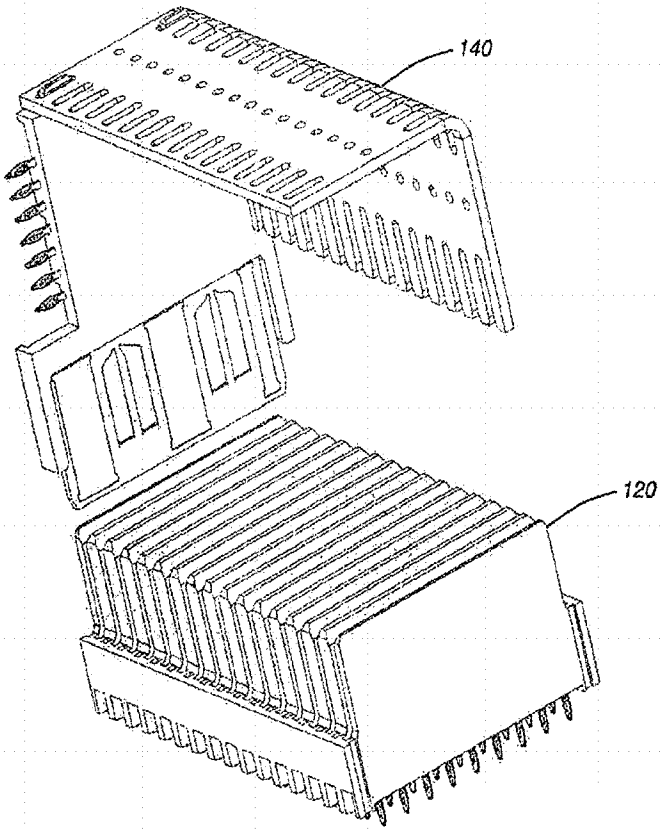

FIGS. 1A-1C disclose a connector assembly 100 that may be constructed using embodiments of the invention. In the embodiment illustrated, connector assembly 100 is configured as a right angle connector for mating a backplane and a daughter board. However, the invention is not limited by the intended application and embodiments may be constructed for use as stacking connectors, mezzanine connectors, cable connectors, chip sockets or in any other suitable form. In the pictured embodiment, the connector assembly 100 includes a wafer assembly 110 that may be attached to a daughter board and a backplane connector 120 that may be attached to a backplane.

In the embodiment illustrated, wafer assembly 110 includes a plurality of individual wafers 130 supported by an organizer 140. The organizer 140 may be formed of any suitable material, including metal, a dielectric material or metal coated with a dielectric material. Organizer 140 includes a plurality of openings 142 corresponding to each wafer 130. The organizer 140 supports the wafers in a side-by-side configuration such that they are spaced substantially parallel to one another and form an array. The organizer 140 may include dielectric portions (not shown) that extend in the spaces between the wafers 130.

The array of wafers 130 define a board interface 150 for engaging the daughter board (not shown), and a mating interface 152 for engaging the backplane connector 120 (FIG. 1A). The organizer 140 may include first and second sections 144 and 146 forming an L-shape. However the organizer 140 may include only one of the first and second sections 144 and 146 or may have any other shape suitable for holding wafers in a desired position. In the embodiment illustrated, organizer 140 is constructed as a single member, but in some embodiments, two or more members may cooperate to form an organizer. In some embodiments, organizer 140 may be omitted and any suitable mechanism may be used to hold the wafers in an assembly.

The wafers 130 may contain projections or other attachment features that engage the organizer 140 via openings 142 (FIG. 1B) by any suitable attachment mechanism, including a snap engagement, an interference fit or keyed segments. The openings 142 may be disposed in either or both of the first and second sections 144 and 146 of the organizer. Moreover, it is not crucial to the invention that organizer 140 include openings to receive features from wafers 130 because any suitable attachment mechanism may be used, including having projections from organizer 140 engage wafers 130.

Figure 1D:
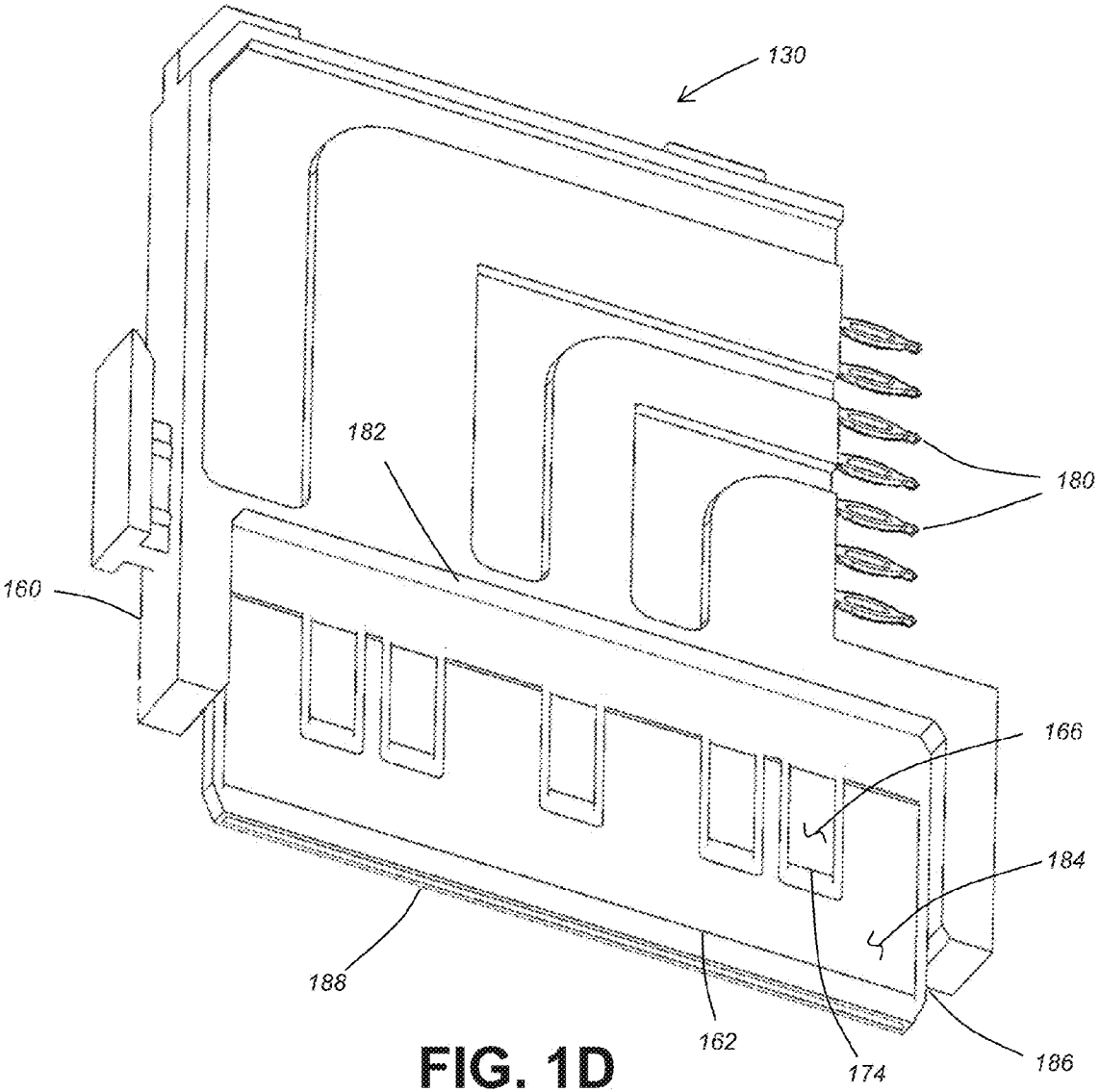
FIG. 1D illustrates a wafer that may be used in a connector assembly according to an embodiment of the invention.
Figure 1E:
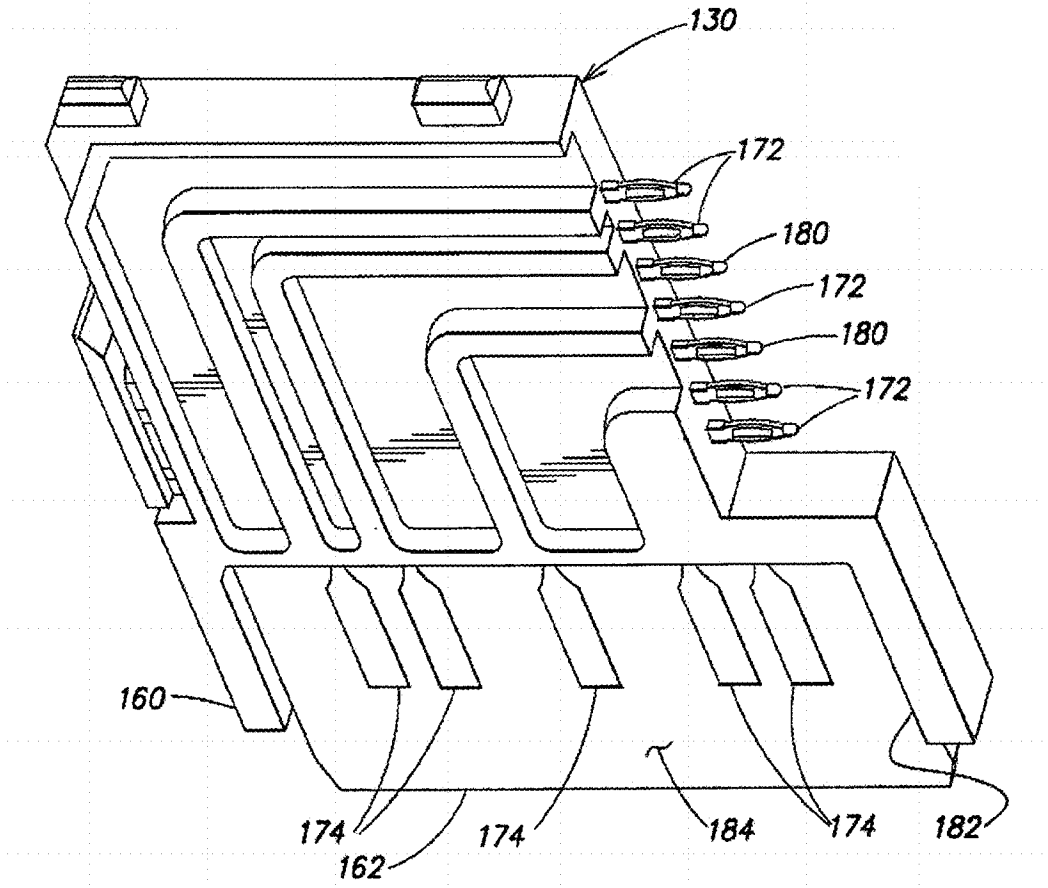
FIG. 1E illustrates a wafer that may be used in a connector assembly according to an embodiment of the invention.

FIGS. 1D and 1E show a wafer 130 according to an embodiment of the invention that may be used in a wafer assembly 110. Each wafer 130 (FIGS. 1D and 1E) includes a housing 160 supporting one or more conductive elements. The conductive elements may be shaped and positioned to conduct signals and reference potentials. In the embodiment illustrated, signal conductors and reference conductors have different shapes. The signal conductors may be positioned to carry differential signals and/or single-ended signals. In the embodiment of FIGS. 1D and 1E, wafer 130 is configured to carry two differential signals and one single-ended signal.

Each signal conductor may have a contact tail designed to be attached to a printed circuit board. In the embodiment of FIGS. 1D and 1E, the contact tails are in the form of press-fit contacts forming terminals 172. However, any suitable contact tail may be used, including posts, surface mount J-leads, through-hole leads or BGA pads. Terminals 172 may have compliant segments that may be compressed to fit in a conductive via in a printed circuit board or other substrate. Once inserted in the via, the compliant member exerts an outward force to make electrical contact to the via and to provide mechanical attachment of wafer 130 to the board. In some embodiments, the mechanical attachment provided by terminals of wafer 130 may adequately secure wafer 130. In other embodiments, additional mechanical attachment structures may be used.

Each signal conductor also has a mating contact portion, adapted to make connection to a conductive element within blackplane connector 120. In the embodiment of FIGS. 1D and 1E, each mating contact portion is shaped as a conductive pad, illustrated as a terminal 174. In this embodiment, terminals 174 provide pads against which one or more compliant segments from a mating contact may press to make electrical connection between wafer assembly 110 and a backplane connector 120. However, wafer 130 may have any suitable form of mating contact portion.

Each signal conductor also includes an intermediate portion, joining the first terminal 172 to the second terminal 174. The intermediate portion forms a signal track 166 through the wafer. In this way, signals may be transmitted from a circuit card, through the wafer 130 to a backplane connector 120, which in turn may be connected to conductive traces in a backplane (not shown).

Each wafer 130 may also include one or more reference potential, or ground, conductors. In the embodiment of FIGS. 1D and 1E, each wafer includes a single reference potential conductor that has a generally planar shape. In the embodiment illustrated, the reference potential conductor includes contact tails and mating contact portions. The contact tails may also be in the form of press fit contacts forming ground terminals 180. However, any suitable mechanism may be used to attach the reference potential conductors to a printed circuit board or other substrate. In the embodiment illustrated, the mating contact portions of the reference potential conductors are also in the form of pads against which a beam or other compliant member from a mating contact in backplane connector 120 may press to form an electrical connection. In the embodiment illustrated, the mating contact portions are formed by exposed surface areas 184 of the reference potential conductor.

In the embodiment of FIGS. 1A-1G, each wafer assembly includes a generally planar reference potential conductor that runs parallel to the signal conductors. In this configuration, the reference potential conductor may act as a shield 162 that reduces cross-talk between signal conductors in adjacent wafers 130 of wafer assembly 110. Additionally, configuring a signal track parallel to such a shield member may form a micro strip transmission line, having desirable electrical properties, including a controlled impedance and few discontinuities that could create signal reflections.

To provide a desirable spacing between signal tracks and a corresponding shield, the signal conductors and reference potential conductors may be held within a housing 160. Wafer 130, for example, may be formed by insert molding conductive elements in housing 160. In such an embodiment, housing 160 may be an insulative material, such as a plastic or nylon. However, any suitable material may be used to form housing 160.

Each shield 162 includes ground terminals 180 separate from the signal tracks 166 and formed integrally with the shields, such that the shields and ground terminals 180 form a unitary, one-piece member. The ground terminals 180 extend from each shield at board interface 150 for engagement with the daughter board, such as by a press-fit. Because the ground terminals 180 are formed integrally with shield 162, a separate connection is not required between the ground terminals 180 and the shields, which may reduce manufacturing costs and provide a more robust connector.

Each wafer housing 160 may substantially encapsulate shield 162. Though, in some embodiments, only a portion of shield 162 may be embedded in housing 160. In yet further embodiments, other mechanisms may be used to hold a shield in a wafer, such as by snapping or otherwise attaching shield 162 to housing 160.

In the embodiment illustrated, each housing 160 includes a cutout portion 182 that forms a mating segment. Cutout portion 182 exposes the second end terminals or pads 174 of the signal tracks 166 for connection with the backplane connector 120. Surface areas 184 (FIG. 1D) of the shield around the pads 174 are also exposed and provide a ground connection.

Shield 162 may extend to edge 186 of the housing 160 to form a ground plane extension 188. When the wafers 130 are held in a wafer organizer 140 to create a wafer assembly 110, ground plane extensions 188 of the individual wafers will be exposed at mating interface 152. If any object that has a static charge on it comes into contact with mating interface 152, that static charge will be conducted through the ground plane extensions 188, through shields 162, through terminals 180 into the ground system of a printed circuit board to which wafer assembly 110 is attached. Because terminals 174, which may be connected to signal generating devices on a daughter board, are not exposed at mating interface 152, the possibility that static electricity will be discharged through the signal conductors is significantly reduced. Avoiding discharge of static electricity through the signal conductors may be desirable because static electricity discharged through a signal conductor may create a damaging voltage on an electronic component on a daughtercard to which wafer assembly 110 is attached.

Figure 1F:
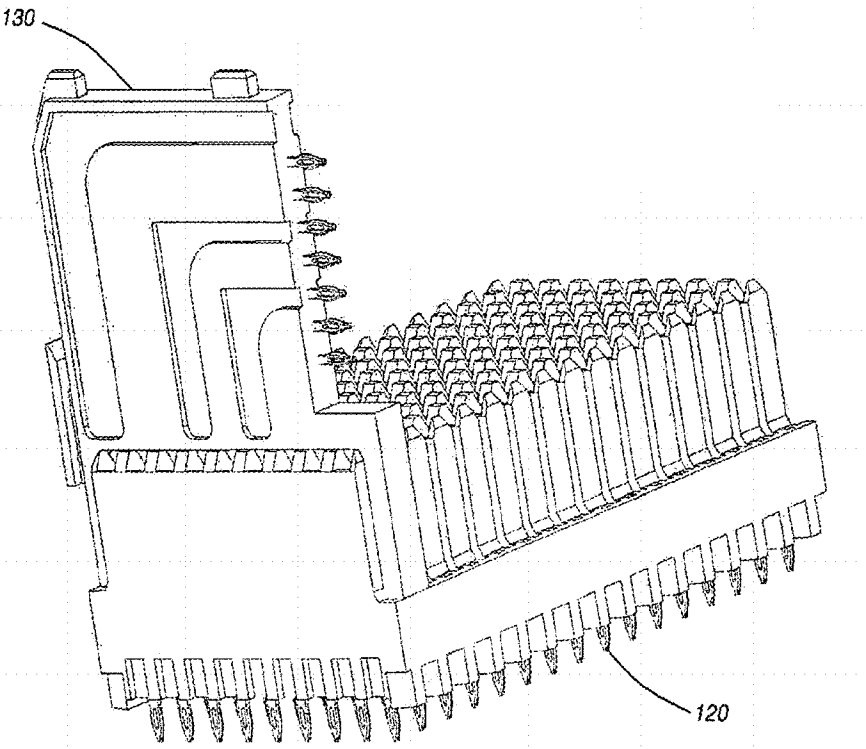
FIGS. 1F and 1G illustrate mating of conductive elements in a wafer and a backplane connector according to an embodiment of the invention.
Figure 1G:
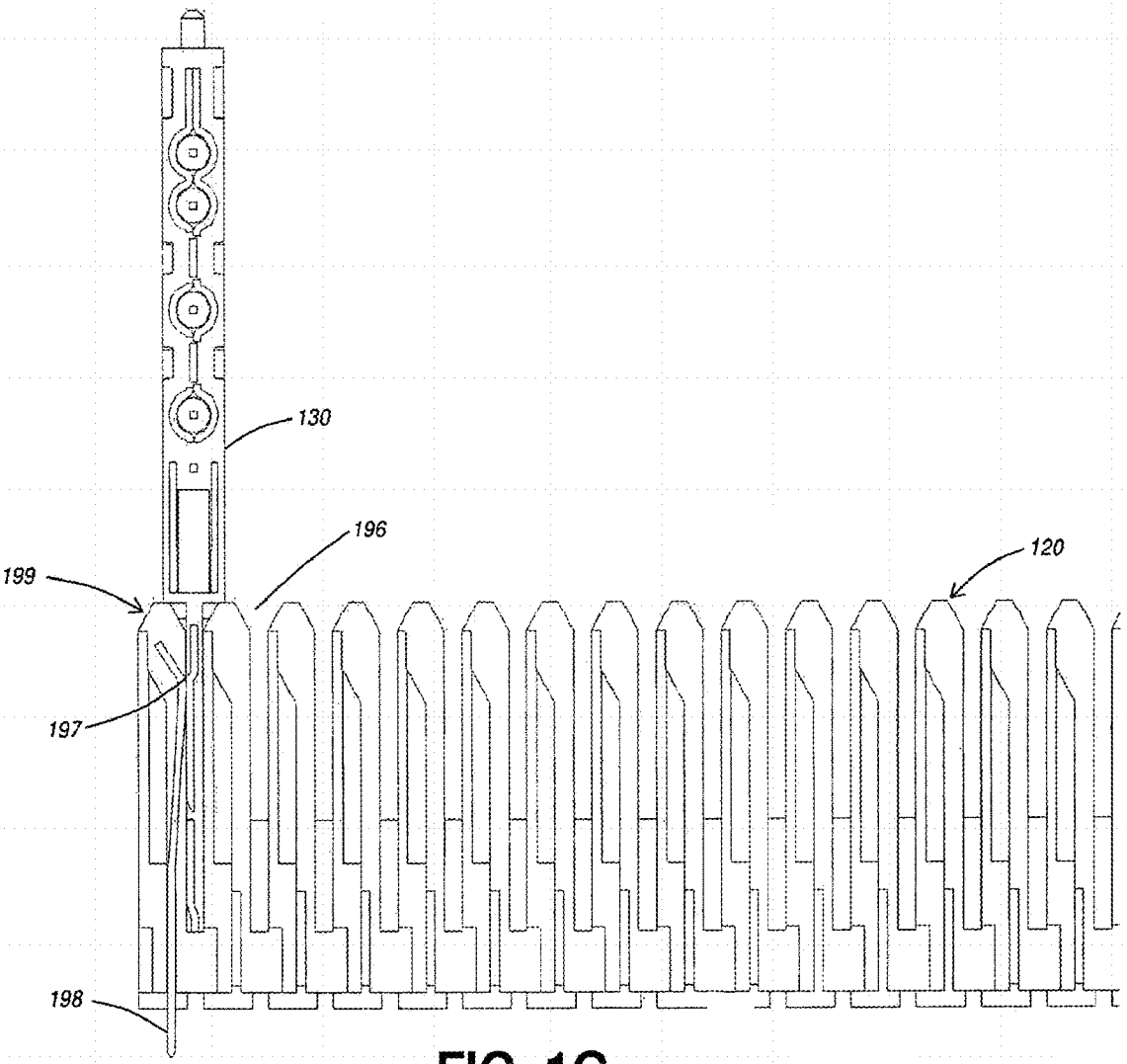

FIGS. 1F and 1G illustrate mating of conductive elements within a wafer assembly 110 to conductive elements within a backplane connector 120. The backplane connector 120 includes a housing 192 with a mating interface 194 for engaging the mating interface 152 of the array of wafers 130 (FIG. 1A). The housing 192 includes an array of slots 196 for receiving corresponding individual wafers 130. In the embodiment illustrated, each slot 196 receives a cutout portion 182 of a corresponding wafer 130.

A plurality of conductive elements may be positioned along each slot 196. Each conductive element may have a mating contact portion, adapted to mate with a conductive element within wafer assembly 110 when wafer assembly 110 is mated with backplane connector 120. In the embodiment illustrated, the conductive elements of backplane connector 120 include signal conductors positioned and shaped to mate with the signal conductors in wafer assembly 110 and ground conductors positioned and shaped to mate with the ground conductors in wafer assembly 110.

In the embodiment illustrated, each conductive element in backplane connector 120 has a contact tail extending from housing 192 for attachment to a printed circuit board or other substrate, such as a backplane. The conductive elements in backplane 120 may be in any suitable form. In the embodiment illustrated, the signal conductors and the ground conductors have different shapes. The signal conductors are in the form of elongated beams, with each signal conductor having multiple beams to provide multiple points of contact with a terminal 174. The ground conductors are in the form of opposing compliant segments that form a slot adapted to receive an exposed portion of a shield 162. However, any suitable size or shape of mating contact portion may be used.

In the embodiment illustrated in FIG. 1G, a signal contact 198 within backplane connector 120 is illustrated with a hook-shaped end 199. Hook-shaped end 199 is adapted to be retained within housing 192, while allowing contact surface 197 to extend into a slot 196 to make contact with a mating contact portion of a conductor from a wafer 130. This configuration may be desirable to reduce stubbing upon insertion of a wafer 130 into a slot 196.

Figure 1H:
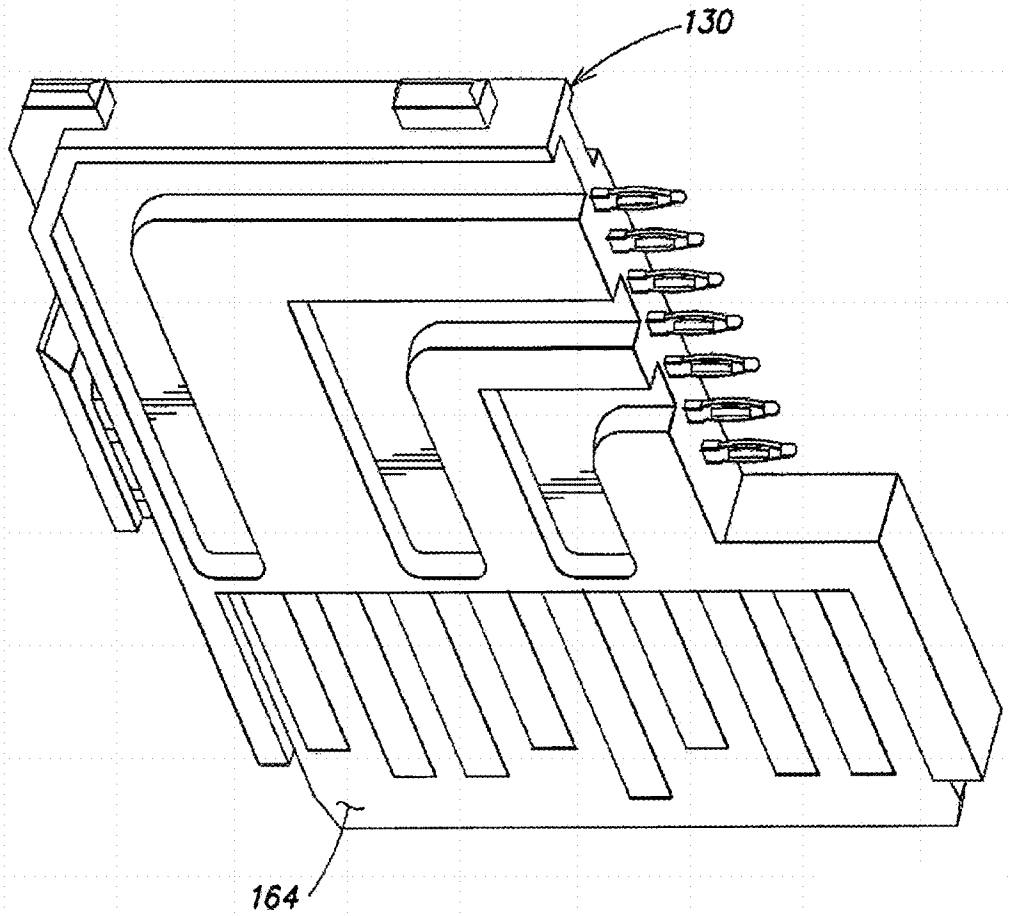
FIG. 1H illustrates a wafer according to an alternative embodiment of the invention.

FIG. 1H illustrates an alternative embodiment of a wafer 130. In the embodiment of FIG. 1H, wafer 130 has a different number of signal conductors than the embodiment illustrated in FIG. 1D. However, the number and positioning of signal conductors is not a limitation on the invention, and a wafer of any number of signal conductors may be constructed according to embodiments of the invention.

Figure 1I:
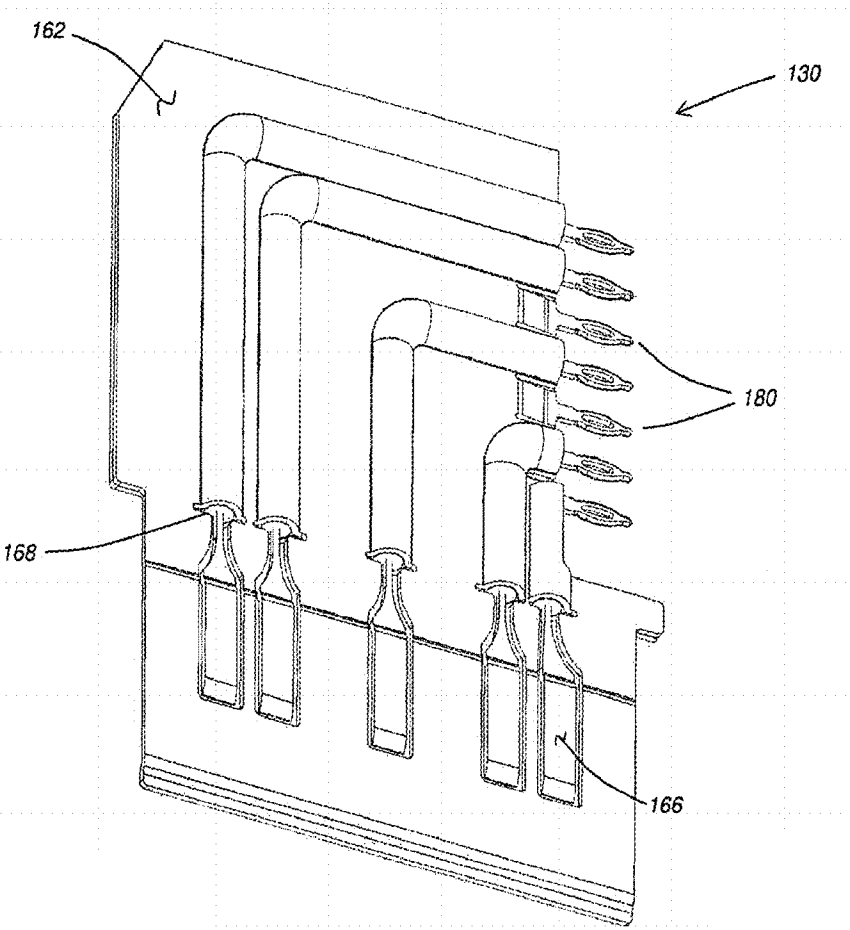
FIGS. 1I and 1J illustrate construction of a wafer according to an alternative embodiment of the invention.
Figure 1J:
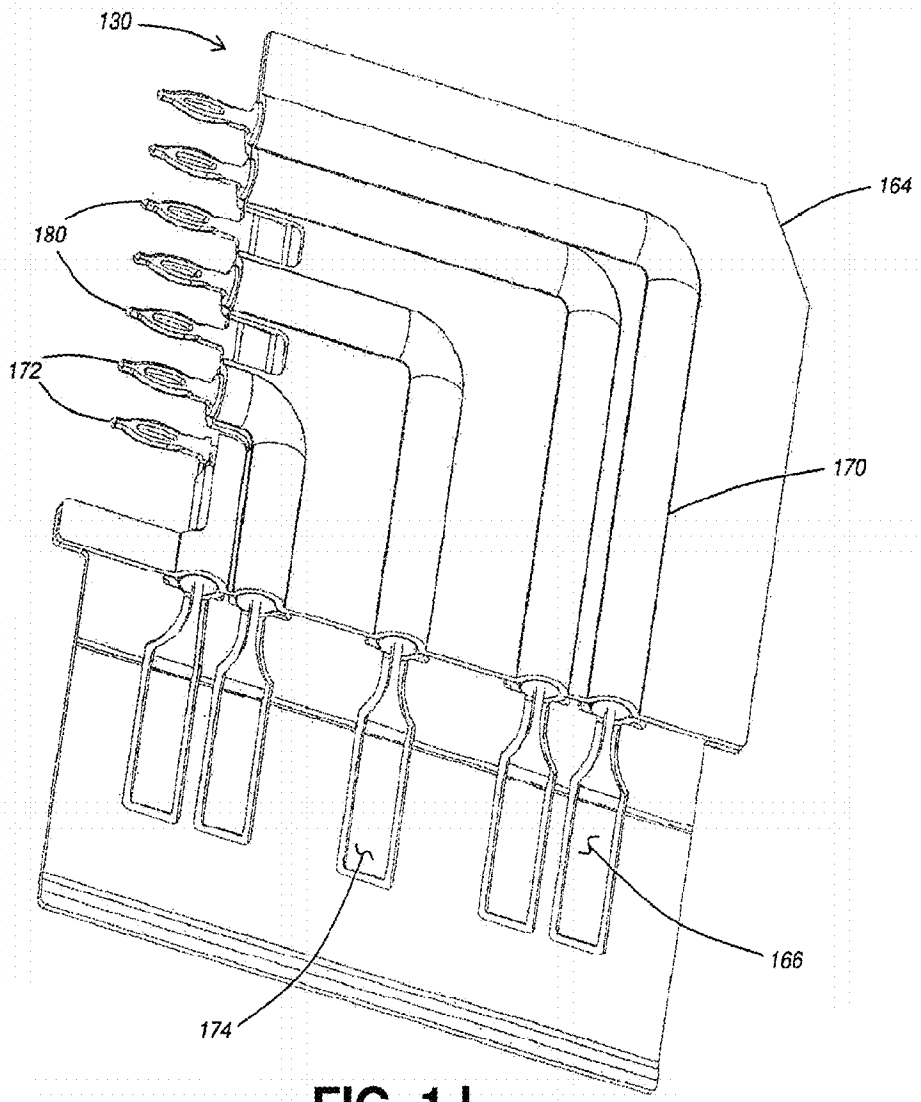

FIGS. 1I and 1J illustrate an alternative approach for constructing a wafer 130. In the embodiment illustrated, two shield members may be used. Each shield may be formed with one or more contact tails adapted to engage a printed circuit board. Each shield also may include a mating contact portion. The shields may be formed to include channels 168 into which signal tracks 166 may be placed. Signal tracks 166 may have the same shape as in the embodiment of FIG. 1D, including contact tails for engagement to a printed circuit board and a mating interface for mating to corresponding signal conductors in a backplane connector. As shown, each signal track 166 includes opposite first and second terminals 172 and 174 at its ends. The first terminal 172 of each signal track 166 may be a press-fit pin at the first mating interface 150, and the second terminal 174 may be a pad at the second mating interface 152.

When the wafer is assembled, signal tracks 166 are sandwiched between channels 168 formed in the shields 162 and 164 (FIGS. 1I and 1J). Surrounding each signal track is insulation 170 that may substantially fill the channels 168 of the shields 162 and 164. In the embodiment illustrated, the insulation is in the form of a plastic or other moldable material, though some or all of the insulation may be air or other suitable material.

FIGS. 2A-2K illustrate a second embodiment of the present invention, including a connector assembly 200 with a wafer assembly 210 and a backplane connector 220. Similar to wafer assembly 110 of above described embodiments, wafer assembly 210 includes an array of wafers 230 and an organizer 240. Wafer assembly 210 has a board interface 250 and a second mating interface 252.

Figure 2A:
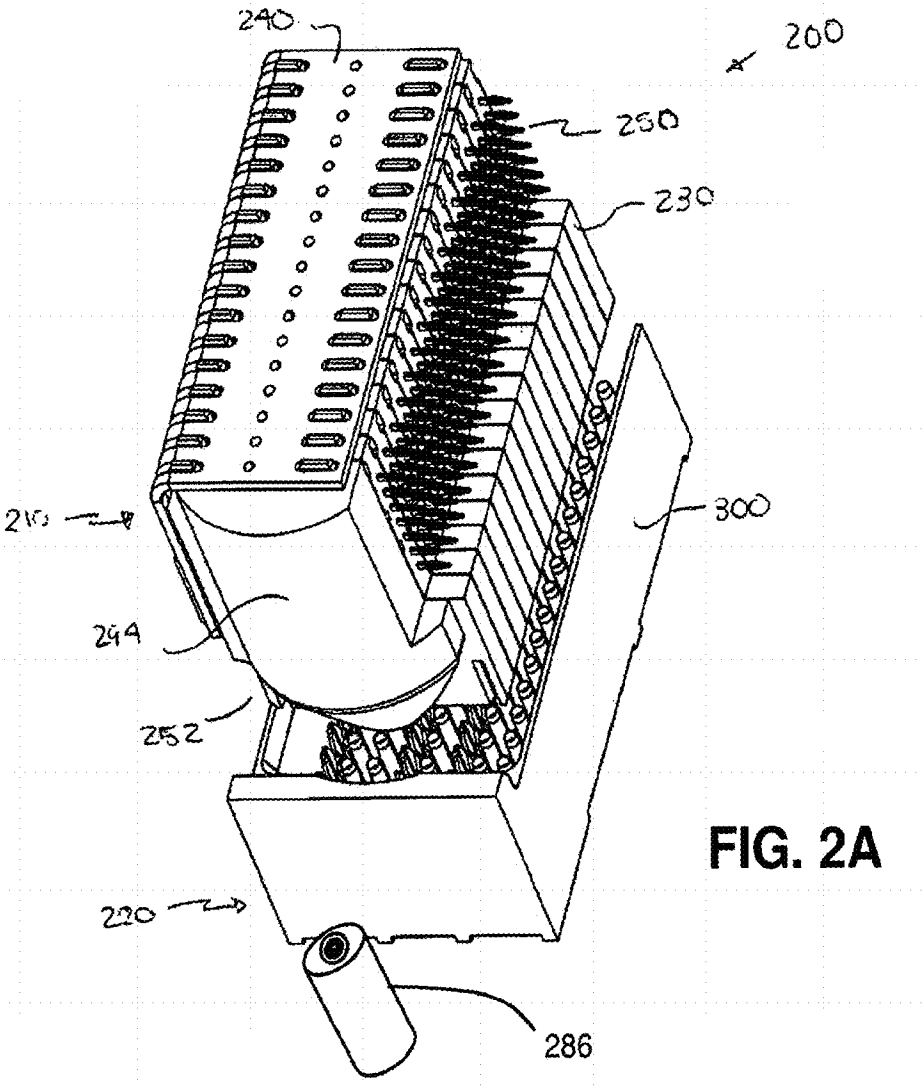
FIGS. 2A-2D illustrate another exemplary embodiment of a connector assembly in accordance with the present invention.
Figure 2B:
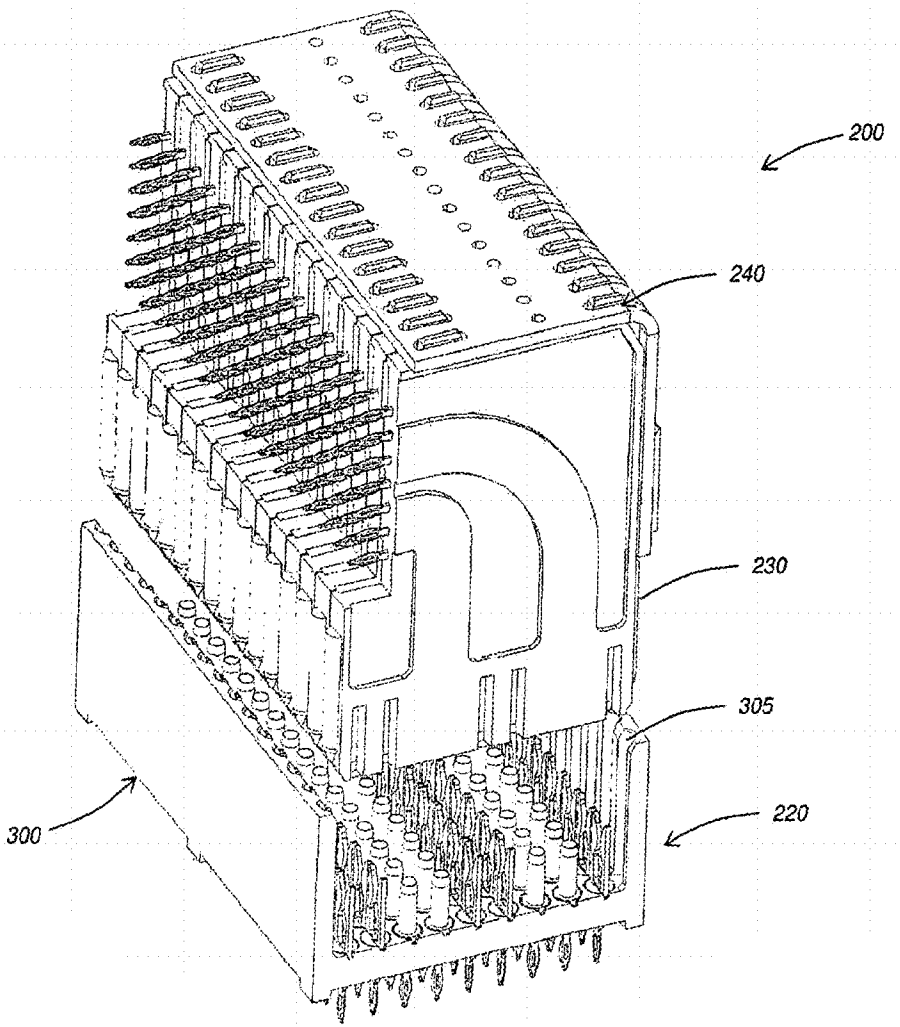
Figure 2C:
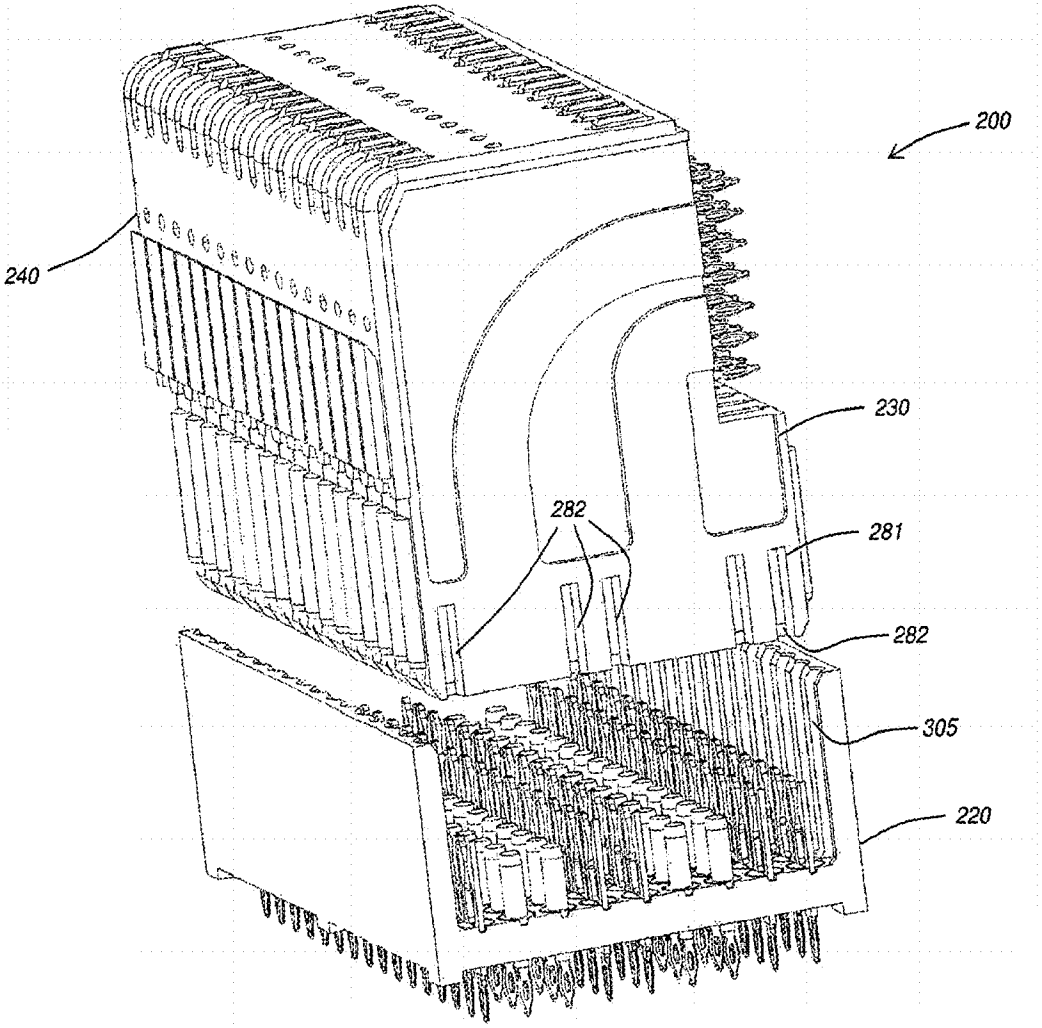
Figure 2D:
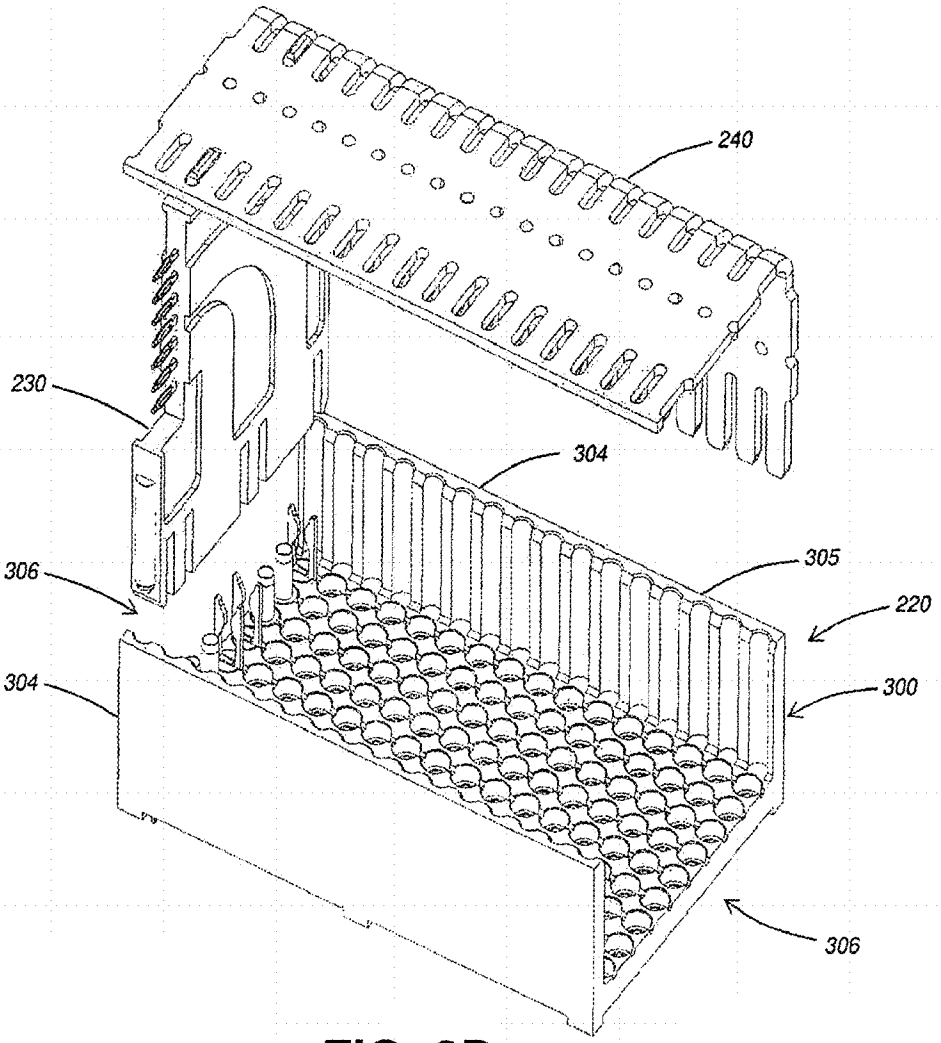
Figure 2E:
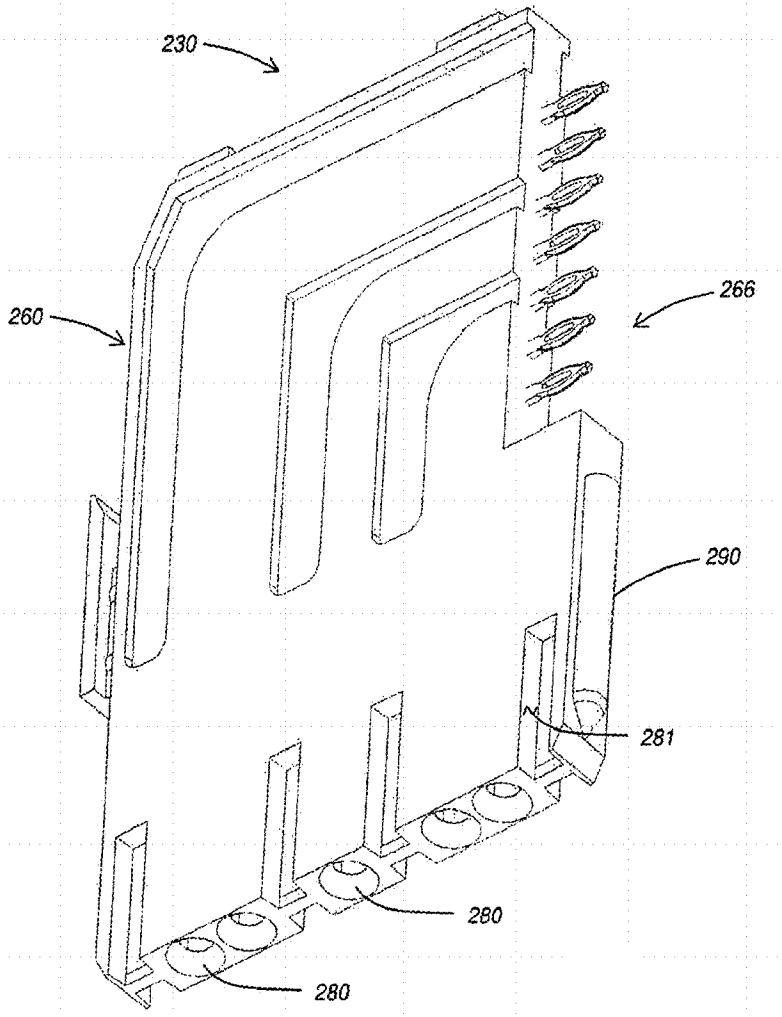
FIG. 2E illustrates a wafer that may be used in a connector assembly of FIGS. 2A-2D.
Figure 2F:
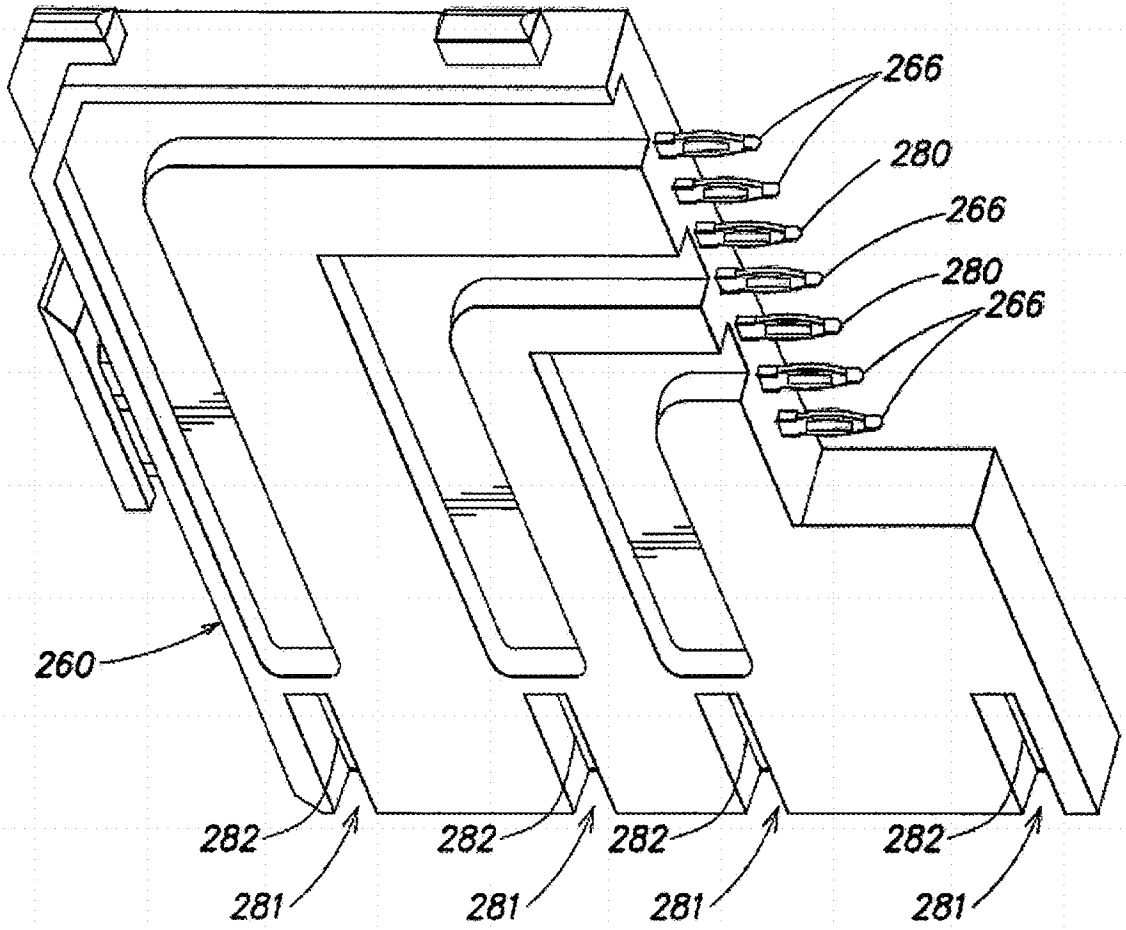
FIG. 2F is a sketch of a wafer that may be used in a connector assembly of connectors 2A-2D according to an alternative embodiment of the invention.
Figure 2G:
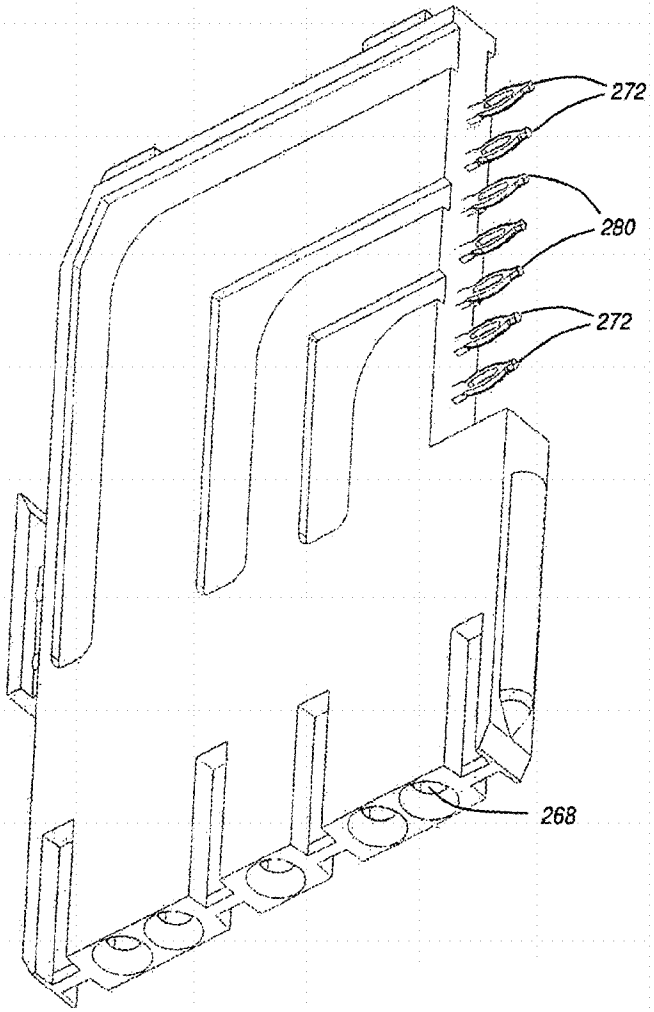
FIGS. 2G and 2H illustrate construction of a wafer that may be used in connector assembly of FIGS. 2A-2D according to an alternative embodiment of the invention.
Figure 2H:
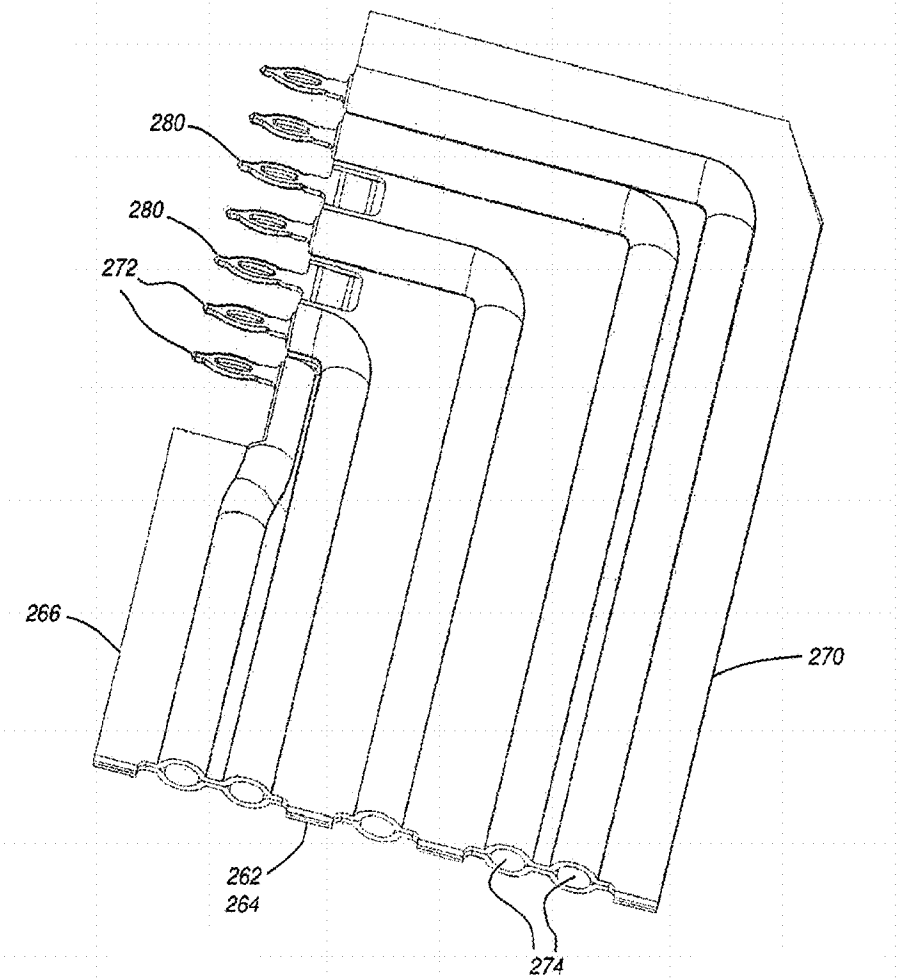
Figure 2I:
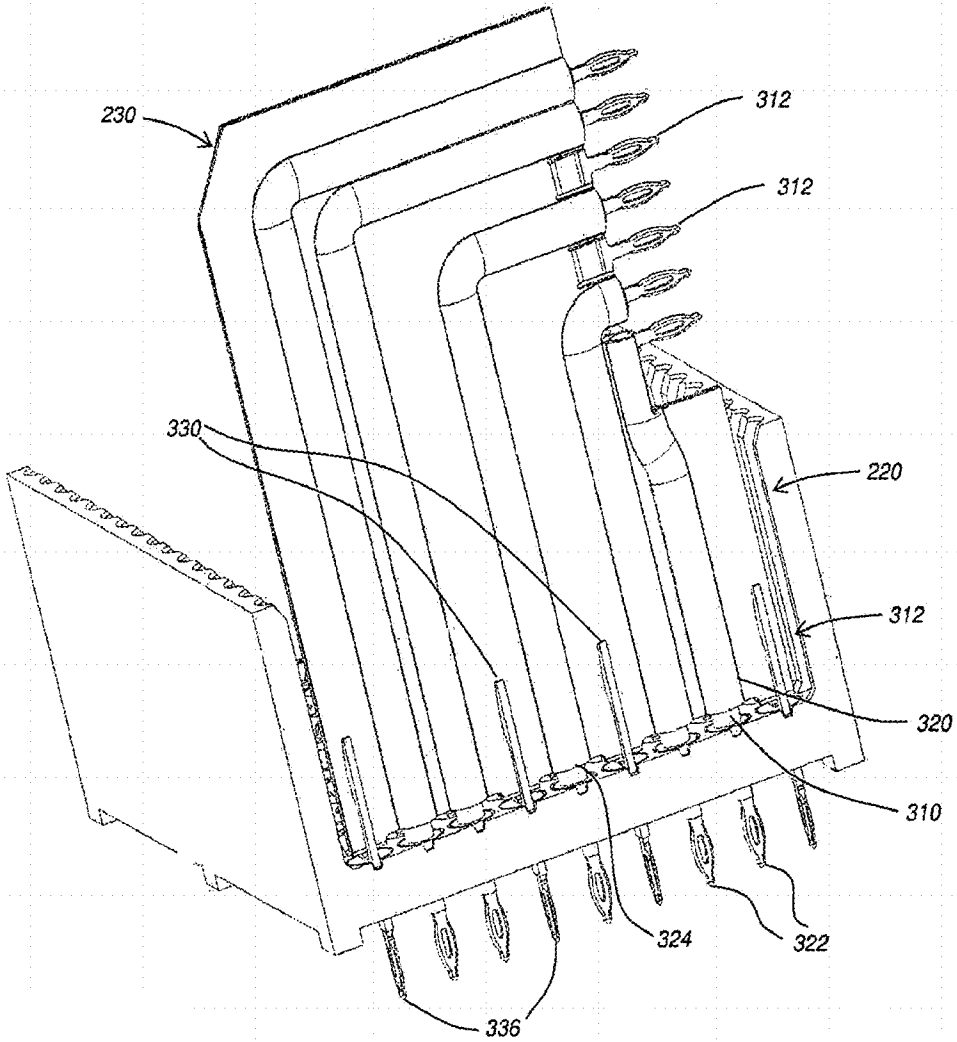
FIGS. 2I and 2J illustrate mating of a wafer to a backplane connector in the connector assembly of FIGS. 2A-2D.

Each wafer 230 of the second embodiment includes a housing 260 supporting first and second conductive shields 262 and 264. Signal tracks 266 are sandwiched between channels 268 formed in the shields 262 and 264 (FIGS. 2G and 2H). Surrounding each signal track may be insulation 270, which may substantially fill the channels 268 of the shields 262 and 264. Molding or other suitable operation may be used to position insulation 270 after signal tracks 266 have been positioned in the recesses. Insulation 270 may be molded around signal tracks 260 before insertion into the channels or after insertion. However, the invention is not limited to embodiments in which insulation fills the channels. Spacers or other suitable mechanisms may be used to electrically isolate tracks 266 from shields 262 or 264.

Each signal track 266 includes opposite first and second terminals 272 and 274 at its ends adapted to form a contact tail for attachment to a printed circuit board or other substrate and a mating contact portion for mating to a corresponding conductive element in a mating connector. The first terminal 272 of each signal track 266 may be a press fit pin at the first mating interface 250.

Unlike embodiments in which mating contact portions were illustrated as pads, wafer 230 is illustrated with signal conductors having mating contact portions that may be shaped as pins or other structures that fit within channels 268. However, terminals 274 may have any suitable shape. Complimentary mating contact portions may be included on signal conductors within backplane connector 220. To receive a mating contact portion in the shape of a pin from a wafer 230, the mating contact portion in backplane connector 220 may be in the form of a receptacle. The receptacle may be surrounded by insulating material to preclude electrical connection between the mating contact portion of a signal conductor in backplane connector 220 and a shield 262 or 264. However, any suitable contact configuration may be used for mating contact portions within backplane connector 220, including using a post within backplane connector 220 and a receptacle at an end of a signal track 266 within the wafer.

Each shield 262 and 264 includes ground terminals 280 separate from the signal tracks 266 and formed integrally with the shields, such that the shields and ground terminals 280 form a unitary, one-piece member (FIGS. 2G, 2H). The ground terminals 280 extend from each shield at the first mating interface 250 for engagement with the daughterboard, such as by press-fit.

A housing 260 may encapsulate the shields 262 and 264 and may include a plurality of vertical slots 281 (FIG. 2F) exposing select portions of the shield to provide ground contact areas 282. However, any suitable mechanism may be used to hold the shields 262 and 264 together. Housing 260 may be formed of any suitable material and, for example, may be a molded dielectric material, such as plastic or nylon. Though, in some embodiments, housing 260 may be conductive or partially conductive. An end of the housing 260 at the second mating interface 252 includes openings 284 corresponding to the ends of the signals 266, thereby defining receptacles for receiving corresponding mating contacts of the backplane connector 220. The housing 260 may also include a guide portion 290 (FIG. 2E) extending from the housing 260 to engage a corresponding slot of the backplane connector 220.

Figure 2J:
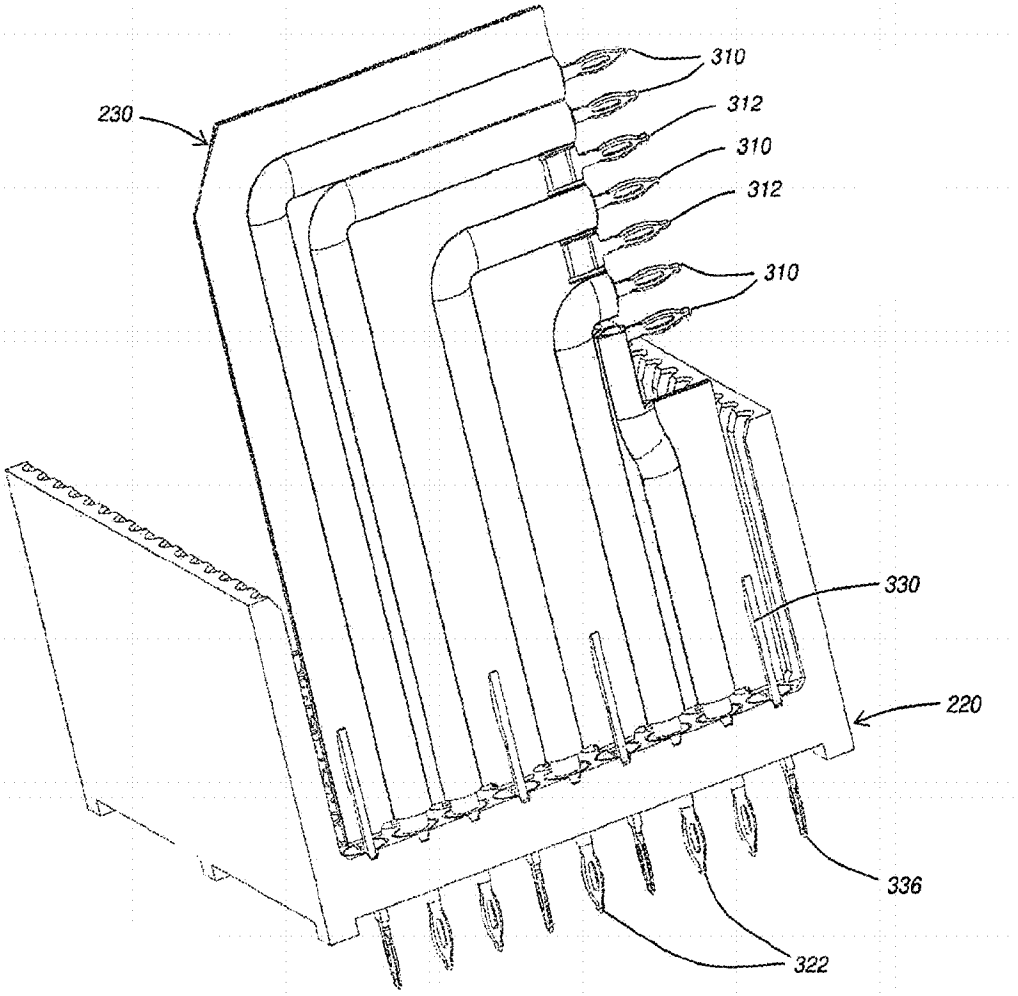

As best seen in FIGS. 2A-2D and 2K, the backplane connector 220 may include a U-shaped housing 300 with a main body 302, two longitudinal sidewalls 304, and two open ends 306. Slots 305 are provided on the inner surfaces of the sidewalls 304 for receiving the wafers 230. Slots 305 may be configured to receive the guide portions 290 of each wafer. A plurality of openings 308 (FIG. 2D) that receive contacts 310 and 312 designated for both signal and ground are located in the main body 302. The contacts 310 and 312 are arranged in rows between open ends 306 and may alternate between signal and ground. For example, five rows of signal contacts 310 may alternate with three rows of ground contacts 312 (FIG. 2J). The signal contacts 310 correspond to the signal tracks 266 of the wafers 230 and the ground contacts 312 correspond to the ground contact areas 282 of the wafers 230.

Each of the signal contacts 310 may include a first end 320, such as a receptacle that mates with the ends of the signal tracks 266 of each wafer 230 at the second mating interface 252. An insulator 324 may be provided around the first ends 320. The second ends 322 extending through the main body 302 may terminate in a press-fit pin for connection to the backplane. Because the first ends 320 of the signal contacts 310 are compliant, movement is allowed when the wafers 230 are mated with the backplane connector 260, thereby providing tolerance.

Each of the ground contacts 312 may include a first end 330 (FIG. 2J) with first and second spring arms for engaging the ground contact areas 282 of each wafer 230. The second opposite ends 324 extend through the main body 302 and terminate in press-fit section 336 for engagement with the backplane.

Figure 2K:
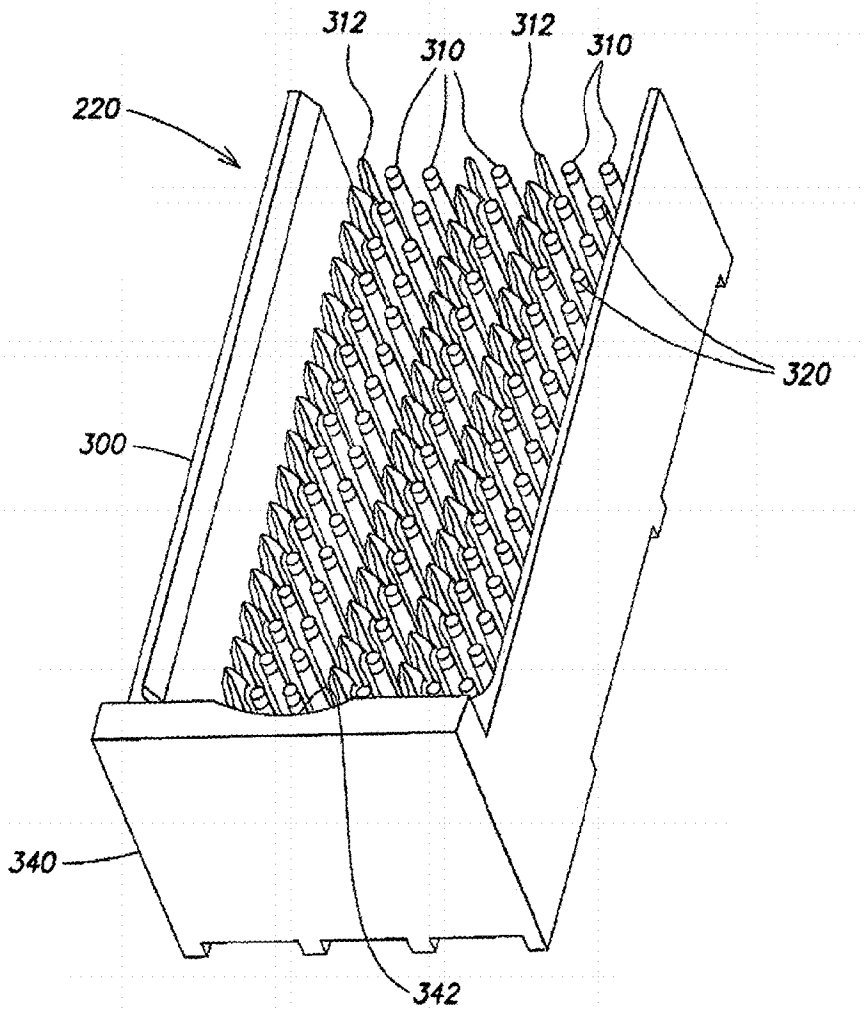
FIG. 2K is a sketch of a backplane connector that may be used with a wafer assembly.

One of the open ends 306 of the housing may be closed off by a guide receiving wall 340 (FIG. 2K). The guide receiving wall 340 may include, for example, a concave recessed portion 342 on its inner surface for receiving the guide piece 292 of the wafer assembly.

Figure 3:
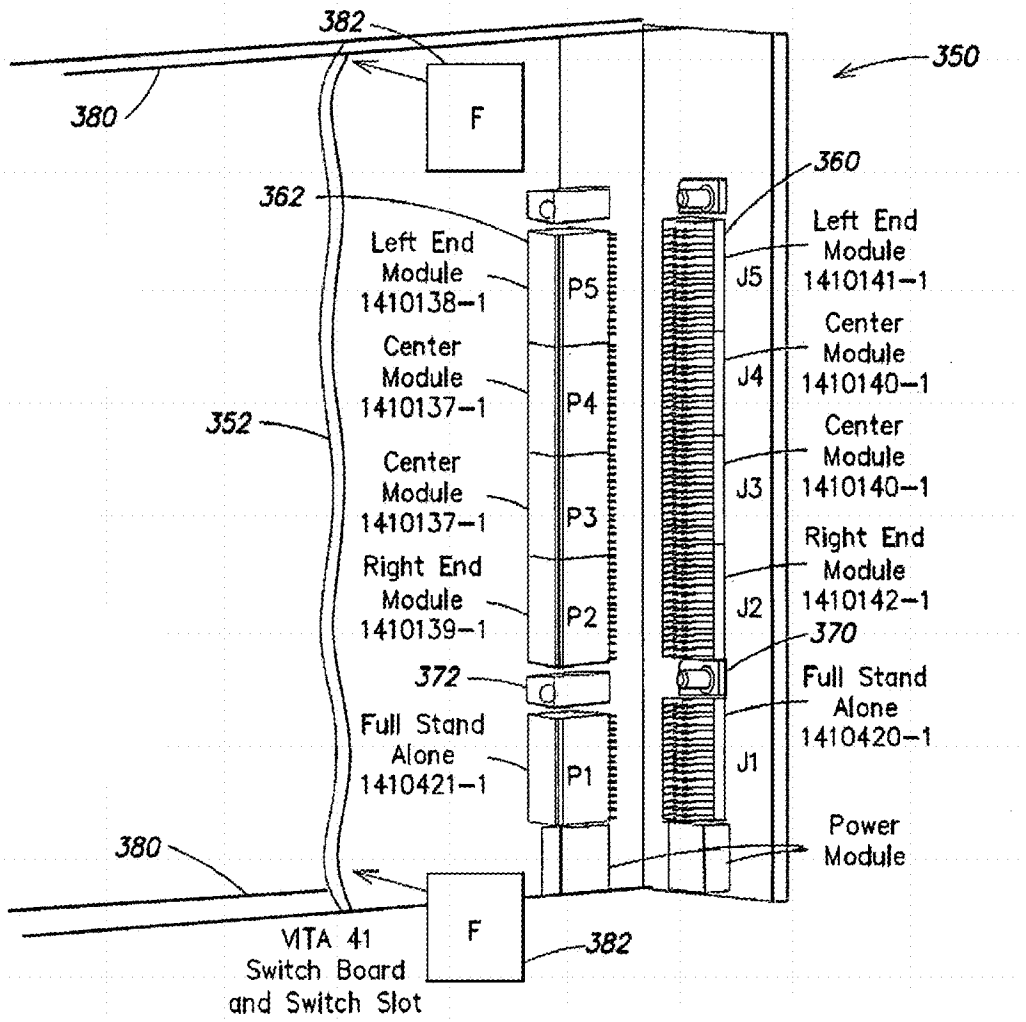
FIG. 3 is a sketch of an electronic assembly that may employ connectors according to an embodiment of the invention.

FIG. 3 illustrates an electronic assembly in which connectors according to embodiments of the invention may be used. FIG. 3 illustrates portions of an electronic assembly that includes a backplane 350. One or more daughter cards 352 may be mounted in the electronic assembly of FIG. 3. Backplane 350 may include one or more backplane connectors 360, which may be constructed according to an embodiment of the invention. Likewise, daughter card 352 may include daughter card connectors 362 according to an embodiment of the invention.

Daughter card 352 may slide along rails 380 that provide a coarse alignment between daughtercard connector 362 and backplane connector 360. More precise alignment may be provided by alignment modules 370 on backplane 350 and corresponding alignment modules 372 on daughtercard 352. In this embodiment, alignment module 370 is in the shape of a post and alignment module 372 is in the shape of a receptacle that has a wide gathering area to ensure that alignment module 372 will engage the post of alignment module 370.

To provide a ruggidized assembly, rail locks 382 are sometimes used to secure daughter card 352 within the electronic assembly. Rail locks 382 are illustrated schematically in FIG. 3. Rail locks operate by pressing daughter card 352 against rails 380 and may be constructed with a camming surface or any other suitable mechanism to assert a force on daughter card 352 to hold it securely in place. Rail locks 382 may be helpful for use in a ruggidized assembly because once engaged, they may limit vibration of daughter card 352. Vibration of daughter card 352 may cause excessive wear or fretting corrosion at the mating interface between daughter card connector 362 and backplane connector 360 or other performance problems. When rail locks 382 operate, daughter card 352 may move relative to backplane 350. For this reason, it may be desirable to incorporate "float" into the connection system formed by backplane connector 360 and daughter card connector 362. As described below, connectors according to some embodiments of the invention may be constructed with features that facilitate float so that rail locks may be used in an electronic assembly to provide a more ruggidized assembly. In other embodiments, float may also be used so that components of a daughter card may be pressed against a cold wall, which may be on one side of slot in an electronic assembly into which a daughter card may be inserted.

FIG. 3 also illustrates how use of a connector using a guide piece such as a guide piece 294 may facilitate construction of electronic assemblies using fluid for cooling. FIG. 2A illustrates a backplane connector 220 designed to receive a daughter card connector with a guide piece 294. Optionally, guide piece 294 may be used in creating additional space on backplane 350 for other components. Accordingly, FIG. 2A illustrates a fluid quick connect 286 mounted adjacent to backplane connector 220. Quick connect 286 is mounted in the same position occupied by alignment module 370. Quick connector 286 may be used to distribute cooling fluid to a daughter card, such as daughter card 352, when inserted into an electronic assembly.

Figure 4:
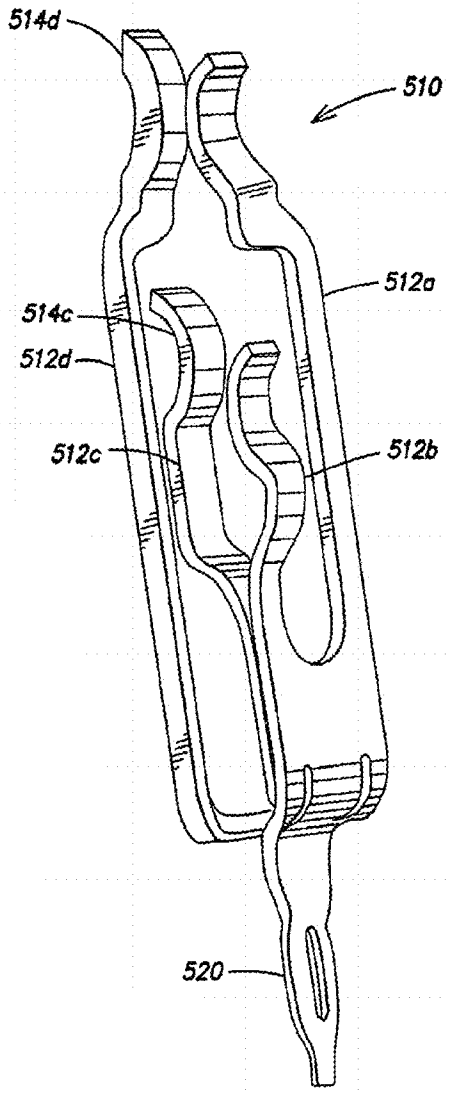
FIG. 4 is a sketch of a conductive element according to an embodiment of the invention.

FIG. 4 illustrates conductive element 510 that may be used in a backplane connector according to an embodiment of the invention. In the embodiment illustrated, conductive element 510 is designed for use in a ruggedized system—both because it facilitates connector float so that rail locks may be used and because it provides reliable contact. Conductive element 510 includes four beams, 512*a*, 512*b*, 512*c* and 512*d*. Each of the beams has a contact surface, of which contact surfaces 514*c* and 514*d* are visible in FIG. 4. Conductive element 510 is designed to receive a mating contact portion so that beams 512*a* and 512*b* press on one side of the mating contact portion and beams 512*c* and 512*d* press on an opposing side of the mating contact portion.

In this way, conductive element 510 provides four points of contact. Providing multiple points of contact increases the reliability of any electrical connection formed between conductive element 510 and a mating contact portion. Further, in the embodiment of FIG. 4, beams 512*a*, 512*b*, 512*c* and 512*d* are curved to bring the contact surfaces near the center of conductive element 510. By positioning the contact surfaces near the center, greater float is enabled. The additional float achieved with the contact configuration of FIG. 4 is illustrated below in connection with FIG. 5D.

Conductive element 510 may be formed in any suitable way. In the embodiment illustrated, conductive element 510 is stamped from a sheet of flexible metal. Conductive element 510 may be formed from a copper alloy, such as beryllium copper or phosphor bronze, or may be formed from any other suitably flexible and conductive material. Conductive element 510 may be formed in any suitable way. In the embodiment illustrated, the beams are stamped from a sheet of metal and then formed as illustrated. A contact tail 520 may be stamped from the same sheet of metal and integrally formed as a part of conductive element 510.

Figure 5A:
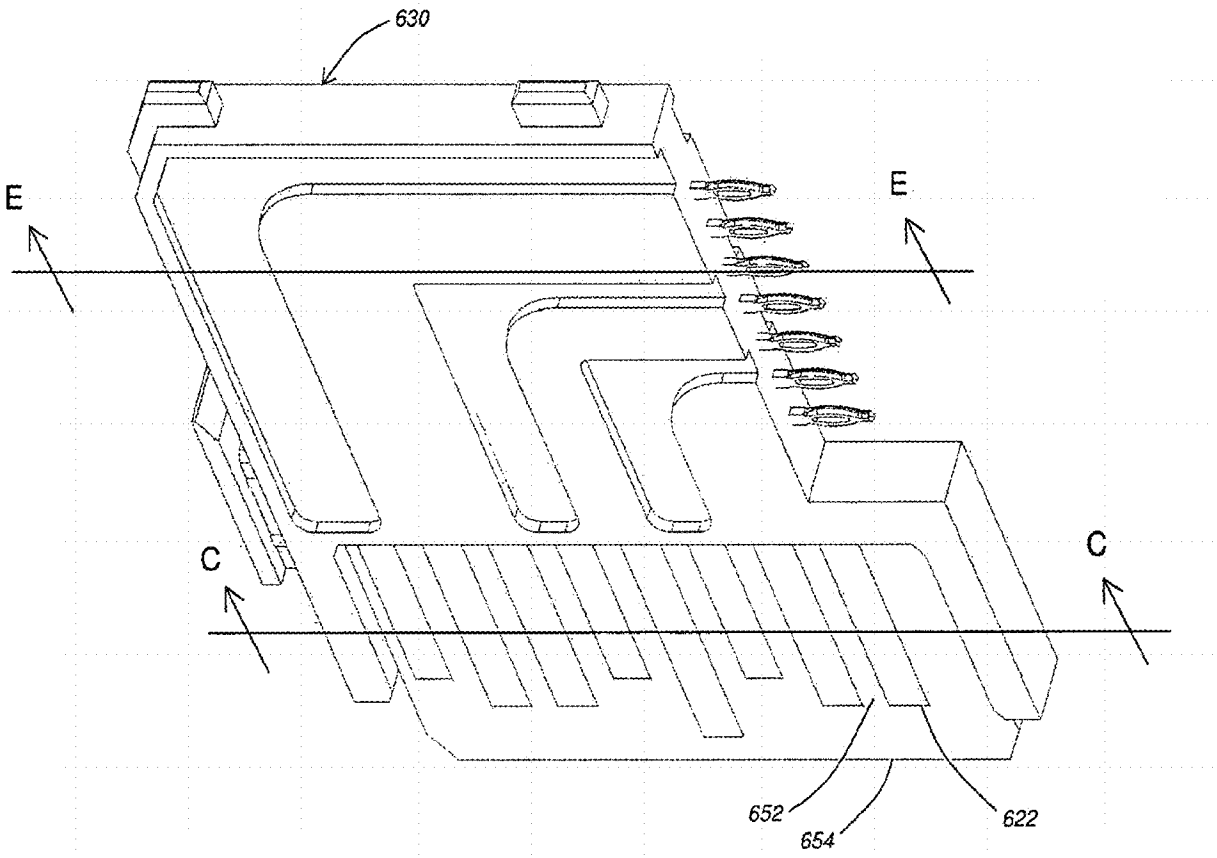
FIG. 5A illustrates a wafer according to an embodiment of the invention.
Figure 5B:
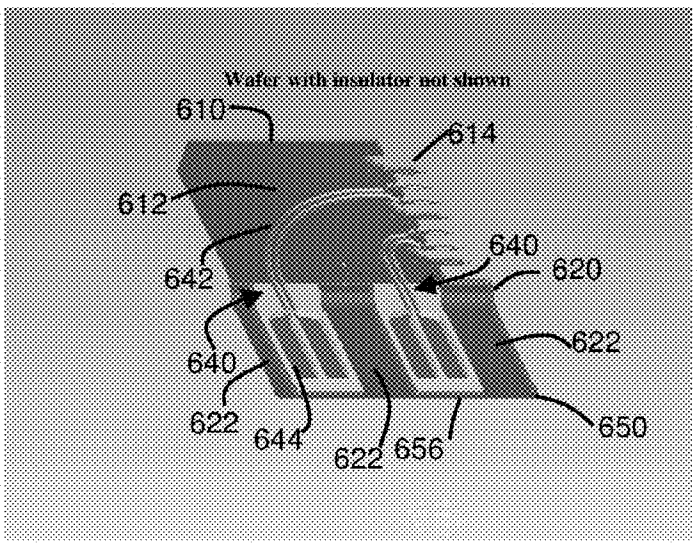
FIG. 5B illustrates conductive elements within the wafer of FIG. 5A.

Turning to FIGS. 5A and 5B, additional details of a wafer 630 according to an embodiment of the invention are shown. FIG. 5A shows wafer 630 including an insulative housing. FIG. 5B shows the conductive elements of wafer 630 without the housing. As shown in FIG. 5B, shield 610 includes a planar portion 612. Contact tails, of which contact tail 614 is numbered, extend from planar portion 612.

Intermediate portion 642 of signal conductors 640 overlay planar portion 612. Intermediate portion 642 may be spaced from planar portion 612 by an amount that provides a desired impedance to signal conductors 640. In the embodiment illustrated, signal conductors 640 are arranged in differential pairs. In a differential configuration, the signal conductors may have an impedance of 100 Ohms or any other suitable value.

Each of the signal conductors terminates in a mating contact portion, here shown as pads 644. In the embodiment of FIG. 5B, the pads 644 are positioned in a plane, forming a column of signal contacts for wafer 630.

In the embodiment illustrated, the column of signal contacts also includes ground contacts. Those ground contacts are formed by pads 622 of shield 610. To align pads 622 in the same plane as pad 644, shield 610 includes a transition region 620 in which shield 610 is bent out of the plane containing planar portion 612 and into the plane containing pads 644. To avoid contact between shield 610 and signal conductors 640, shield 610 may include openings where shield 610 and signal conductors 640 are in the same plane.

As shown in FIG. 5B, pads 622 are separated from pads 644. This configuration avoids shorting signal conductors 640 to ground. When an insulative housing is molded around shield 610 and signal conductors 640, the space between pads 622 and 644 may be filled with insulative material of the housing. This insulative material forms regions 652 (FIG. 5A) and ensures that pads 644 do not touch pads 622. However, any suitable structure for isolating signal conductors 640 from shield 610 may be used.

As described above, it may be desirable for shield 610 to extend to the mating face of wafer 630 to avoid electrostatic discharge through signal conductors. Accordingly, the embodiment of FIG. 5B illustrates edge 650 of shield 610 extending beyond pads 622 and 644 to provide a shield extension 656.

In some embodiments, it may be undesirable to have edge 650 exposed on the surface of wafer 630 where mating contacts from a backplane connector engage pads 644. If shield extension 656 were exposed, a mating contact portion in a backplane connector sliding across the surface of wafer 630 to engage a signal pad 644 could be shorted to shield extension 656. Accordingly, edge 650 may be thinner than pads 644 and may be over-molded with insulative portion 654 (FIG. 5A). Insulative portion 654 prevents a mating contact sliding into engagement with pads 644 from contacting shield extension 656.

Shield 610 and signal conductors 640 may be formed in any suitable way. For example, they may be stamped from sheets of metal and formed into the desired shapes. In the embodiment illustrated, shield 610 and signal conductors 640 may be separately stamped and overlaid after stamping. Though in other embodiments, both shields and signal conductors may be stamped from the same sheet of metal. Shield extension 656 may be formed in any suitable way. For example, shield extension 656 may be formed to be thinner than pads 644 by coining edge 650 of shield 610.

Figure 5C:
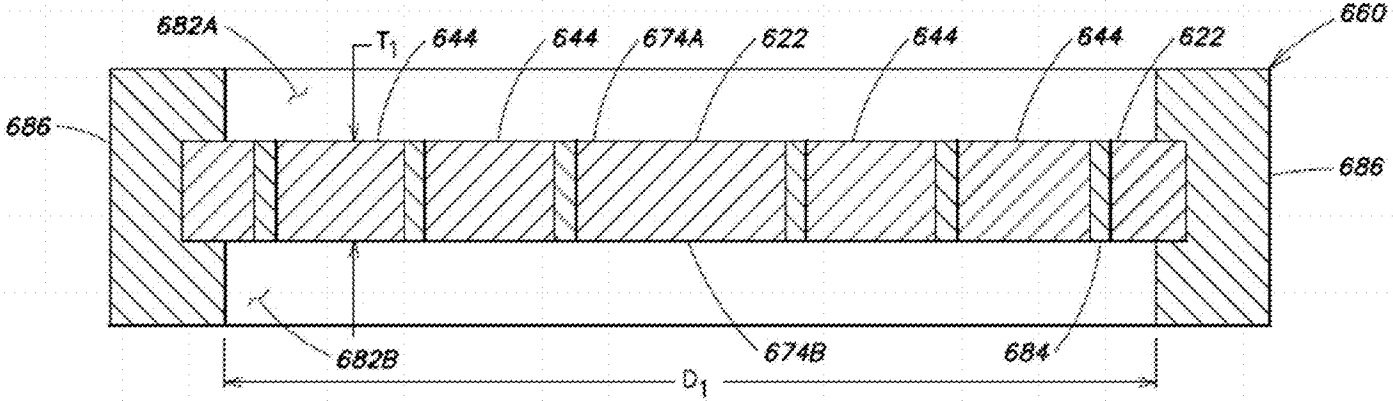
FIG. 5C is a cross-section of the wafer of FIG. 5A through the line C-C.

FIG. 5C shows a wafer 630 in cross-section taken along line C-C through the mating segment of wafer 630. As shown, signal conductors and reference conductors are held within housing 660. Cut-out portions 682*a* and 682*b* on both sides of housing 660 expose terminal portions of the signal conductors and ground conductors, forming pads 644 on the signal conductors and pads 622 on the ground conductors.

In the embodiment illustrated, cut-out portions 682A expose the signal conductors and ground conductors on two surfaces, surfaces 674A and 674B. This configuration allows electrical connection to be made to each of the pads from both surface 674A and 674B. Making contact on two surfaces of a pad may be desirable because redundancy improves the reliability of the electrical connection formed to such a pad.

In some embodiments, the signal conductors and ground conductors are formed from a material having a thickness sufficient to provide a robust pad. For example, the material may have a thickness $T_1$ in excess of 8 mils. In some embodiments, the thickness may be between about 10 and 12 mils.

Figure 5D:
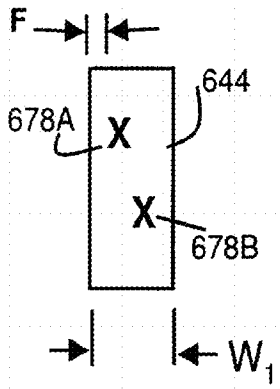
FIG. 5D is a sketch illustrating points of contact on one side of a conductive element of the wafer of FIG. 5A.

In some embodiments, a backplane connector may be formed to create multiple points of contact to each of the signal conducting pads and/or each of the reference conductor pads. For example, FIG. 5D illustrates one surface of a pad 644. Two points of contact, contact point 678A and 678B are illustrated. Two such points of contact may be formed using a conductive element in the form of conductive element 510 (FIG. 4). Two such points of contact may, for example, be formed by beams 512A and 512B pressing against one surface of pad 644. If a contact in the form of conductive element 510 is used, two similar points of contact will be provided on an opposing surface of pad 644. Collectively, four points of contact may thus be formed to pad 644. Providing four points of contact in this fashion may increase the robustness and reliability of a connector formed using wafers such as 630. However, any suitable number of points of contact may be used.

Figure 6:
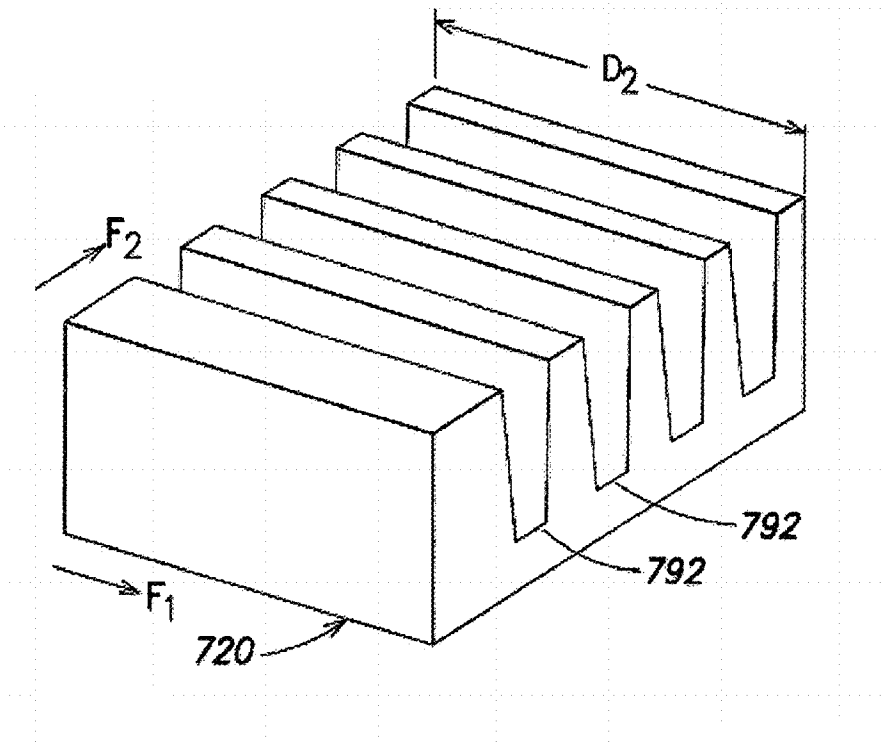
FIG. 6 is a sketch of a backplane housing according to an embodiment of the invention.

FIGS. 5C and 5D also illustrate how a wafer in the form of wafer 630 may accommodate float to accommodate rail locks or for other reasons. Wafer 630 includes a contact portion 684 that is designed for insertion into a slot, such as slot 792, in a backplane connector housing 720 (FIG. 6). Contact portion 684 is bounded by sidewalls 686 that are positioned outside of housing 720 when wafer 630 is mated with a backplane connector. In the embodiment illustrated, sidewalls 686 limit the range of float of wafer 630 relative to housing 720.

In the embodiment illustrated, wafer 630 is formed with cut-out portions 682A and 682B that provide a spacing $D_1$ between sidewalls 686. The dimension $D_1$ may be larger than the width of housing 720 represented by $D_2$ (FIG. 6). By making dimension $D_1$ larger than $D_2$, wafer 630 may float in direction $F_1$ (FIG. 6). Float in direction $F_2$ may also be provided by compliance of beams forming the contact elements in a backplane connector. For example, if a conductive element in the form of conductive element 510 is used, beams 512A, 512B, 512C and 512D may provide float in direction $F_2$. In some embodiments, float in direction $F_1$ may be desirable, but it may be desirable to limit float direction $F_2$ to avoid overstressing the compliant members. In some embodiments, described in more detail below, a guidance pin and block assembly may include float for appropriate components. Such float may be provided in only one direction. Alternatively or additional, stops may be provided near compliant members to prevent the compliant members from being overstressed when mating connectors float relative to each other or in other scenarios.

If wafer 630 is allowed to float in direction $F_1$, it may be desirable that the allowed range of float not preclude alignment of the mating contact portions of conductive elements in a backplane connector and pads 644 in wafer 630. As described above in FIG. 4, the contact surfaces on the beams used to form conductive element 510 are curved to position the contact surfaces closer to the center line of conductive elements 510. As a result, when a contact element 510 is aligned with pad 644, points of contact 678A and 678B between the mating surfaces of element 510 and pad 644 may be positioned near the center of pad 644.

In the embodiment shown, the configuration of the contact element 510 ensures that points of contact 678A and 678B are spaced apart by a distance that is less that the width $W_1$ of pad 644. As a result, wafer 630 may float relative to contact element 510 by an amount F and points of contact 678A and 678B will still be on pad 644. In some embodiments, the difference between dimensions $D_1$ and $D_2$ will be less than the distance F, though any suitable dimensions may be used.

Figure 5E:
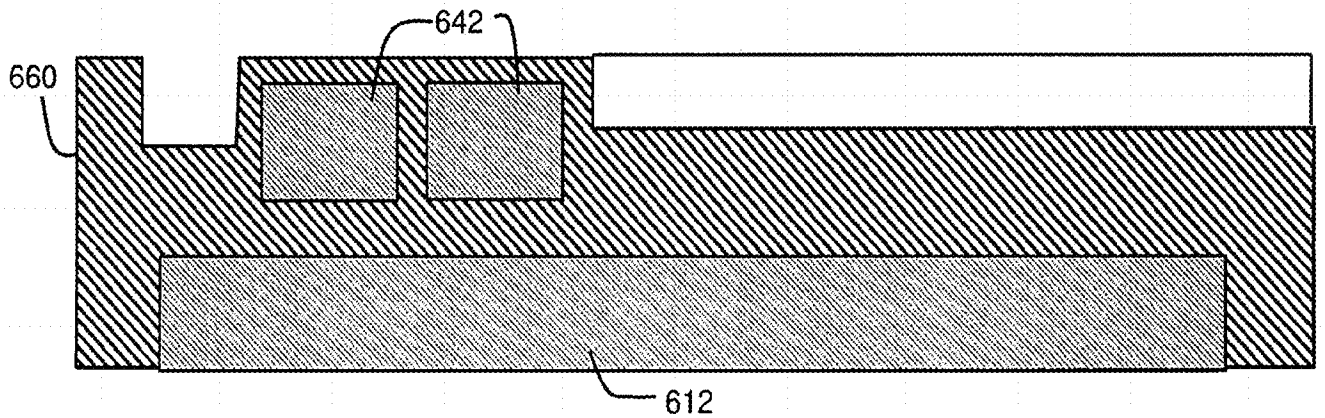
FIG. 5E is a cross-section through the wafer of FIG. 5A taken along the line E-E.

Turning to FIG. 5E, a strip line construction that may be achieved using a wafer as illustrated in FIG. 5A is shown. FIG. 5E shows a cross-section taken through the intermediate portions of signal conductors in wafer 630. In the example shown, the cross-section passes through intermediate portions 642 of signal conductor 640. As can be seen, the intermediate portions 642 are spaced from a ground plane formed by planar portion 612 of shield 610. The desired spacing between intermediate portions 642 and planar portion 612 may be set by insulative housing 660 that may be molded around signal conductors 640 and shield 610.

In the embodiment illustrated, the intermediate portions 642 of signal conductors 640 are embedded with insulative housing 660. Shield plate 610 is partially embedded within housing 660. However, in some embodiments, planar portion 612 may be fully embedded within housing 660.

Figure 7:
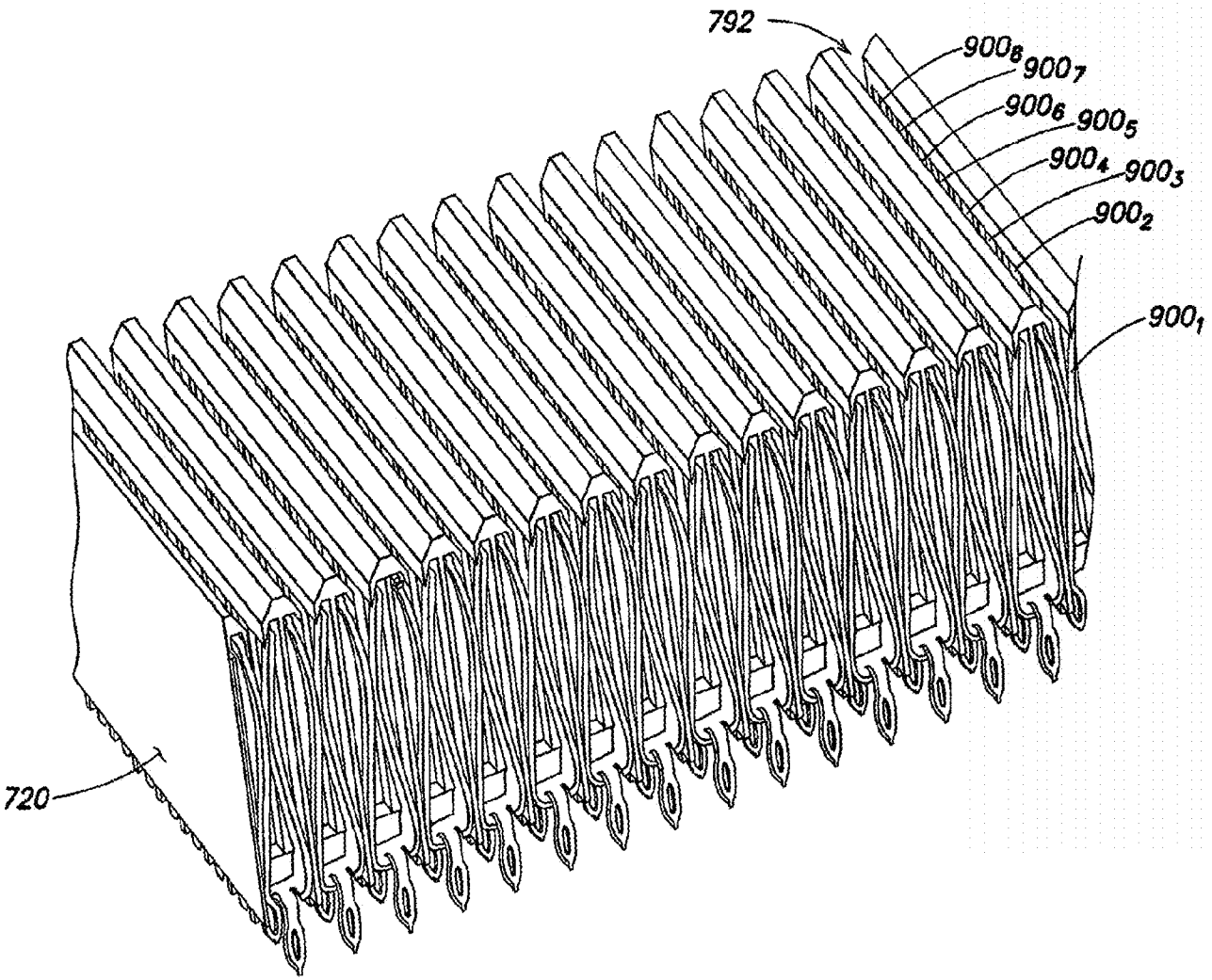
FIG. 7 is a sketch of a backplane connector, partially cut away, according to an embodiment of the invention.

FIG. 7 shows a backplane connector 720 according to some embodiments of the invention. Backplane connector 720 may incorporate contacts such as contact 510 (FIG. 4). Though, in the embodiment illustrated a contact that facilitates more control over insertion force is used. Backplane connector 720 has slots, such as slot 792. Each slot is lined with multiple contacts, of which contacts $\mathbf{900}_1 \ldots \mathbf{900}_8$ are numbered. As shown, eight contacts $\mathbf{900}_1 \ldots \mathbf{900}_8$ per slot are used, though a connector may be constructed with any number of contacts.

In the embodiment illustrated, both signal and ground contacts have the same shape. Though, it is not a requirement that all contacts in a slot have the same shape or that all slots in a connector contain the same number or type of contacts.

Figure 8B:
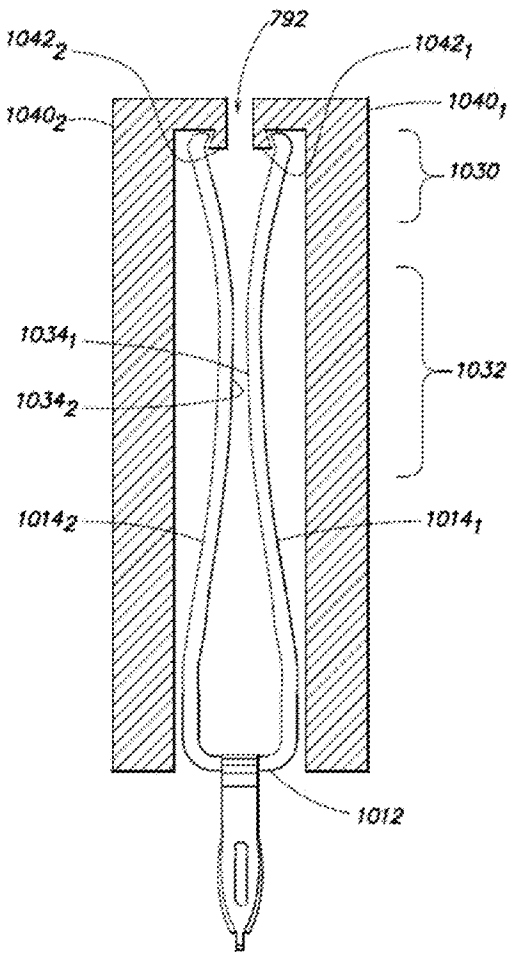
FIG. 8B is a cross sectional view of a portion of the backplane connector of FIG. 7.
Figure 8A:
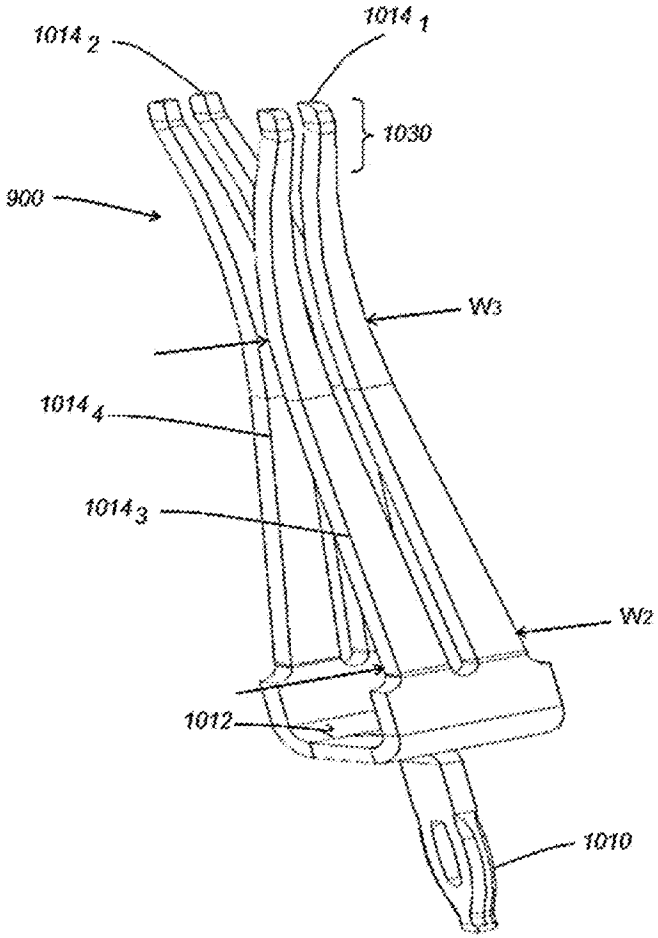
FIG. 8A is a sketch of a contact of the backplane connector of FIG. 7.

A representative contact 900 is shown in FIG. 8A. Contact 900, like contact 510 (FIG. 4), provides multiple points of contact. In the illustrated embodiment, contact 900 provides four points of contact. Though, each contact could provide more or fewer points of contact. Contact 900 also arranges the points of contact to be spaced less than the width of a pad to which contact 900 mates. Such spacing may be used to facilitate float of the connector. Also as with contact 510, contact 900 may be stamped and then formed from a sheet of flexible, conductive material, such as a copper alloy or other suitable metal.

As shown in FIG. 8A, contact 900 is formed with a base 1012. Contact tail 1010 extends from one surface of base 1012. In the embodiment illustrated, contact tail 1010 extends perpendicular to base 1012, though the specific manner in which contact tail 1010 is incorporated into contact 900 is not critical to the invention. Contact tail 1010 may have any suitable shape, though in the embodiment illustrated, contact tail 1010 is a press-fit, eye-of-the-needle contact tail.

Multiple members may also extend from base 1012 to form the mating portions of contact 900. In the embodiment illustrated, four members $\mathbf{1014}_1 \ldots \mathbf{1014}_4$ are shown. In some embodiments, each contact will have an even number of opposing members. An even number of opposing members allows contact 900 to engage two sides of a mating contact portion from a mating connector. However, the number and type of contact members is not critical to the invention.

In the embodiment of FIG. 8A, the members $\mathbf{1014}_1 \ldots \mathbf{1014}_4$ collectively provide four points of contact. FIG. 8B shows a side view of contact 900 in which mating surfaces $\mathbf{1034}_1$ and $\mathbf{1034}_2$ on members $\mathbf{1014}_1$ and $\mathbf{1014}_2$ are visible. Similar mating surfaces may be provided on contacts $\mathbf{1014}_2$ and $\mathbf{1014}_3$, though not visible in FIG. 8B.

As shown in FIG. 8A, members $\mathbf{1014}_1$ and $\mathbf{1014}_2$, where attached to base 1012, span a width of $W_2$. In a mating contact region, the width spanned by members $\mathbf{1014}_1$ and $\mathbf{1014}_2$ decreases to $W_3$. In the illustrated embodiment, $W_3$ is less than the width $W_1$ of a pad, such as pad 644 (FIG. 5D), to which contact 900 may make a connection. This configuration allows for "float," as described above in connection with FIG. 5D.

Though members $\mathbf{1014}_1 \ldots \mathbf{1014}_4$ may have any suitable shape, in the embodiment illustrated, members $\mathbf{1014}_1 \ldots \mathbf{1014}_4$ are shaped to provide a desired insertion force as connectors are mated. As shown in FIGS. 8A and 8B, each of members $\mathbf{1014}_1 \ldots \mathbf{1014}_4$ has a distal portion 1030. Members $\mathbf{1014}_1 \ldots \mathbf{1014}_4$ are tapered such that the distal portions 1030 are narrow relative to other portions of the member. The tapered distal end 1030 can provide an initial low insertion force, while other portions of members $\mathbf{1014}_1 \ldots \mathbf{1014}_4$ may be shaped to provide a higher force to retain a mating contact within contact 900 when a mating contact is fully inserted into contact 900.

FIG. 8B is a side view of contact 900 within a housing. Walls $\mathbf{1040}_1$ and $\mathbf{1040}_2$ may be portions of the housing, such as housing 720 (FIG. 7). Walls $\mathbf{1040}_1$ and $\mathbf{1040}_2$ may be spaced and shaped to provide a slot 792 that can receive a portion of a mating connector between opposing ones of the members $\mathbf{1014}_1 \ldots \mathbf{1014}_4$. Members, such as $\mathbf{1014}_1$ and $\mathbf{1014}_2$, may contain contact surfaces, such as $\mathbf{1034}_1$ and $1034_2$. In the embodiment illustrated, contact surfaces $1034_1$ and $1034_2$ face inwards, towards the center of slot 792 such that when a portion of a mating connector is inserted in slot 792, contact surfaces $1034_1$ and $1034_2$ may press against a corresponding mating contact surface on that portion.

In the embodiment illustrated, the insertion force, or conversely the retention force, generated by a contact 900 may be generated by different portions of the members $1014_1 \ldots 1014_4$, at different times, depending on how far at portion of a mating connector is inserted into slot 792. FIGS. 9A and 9B illustrate a mating sequence and FIG. 9C is a graph depicting insertion force as a function of insertion distance.

Figures 9A, 9B, 9C:
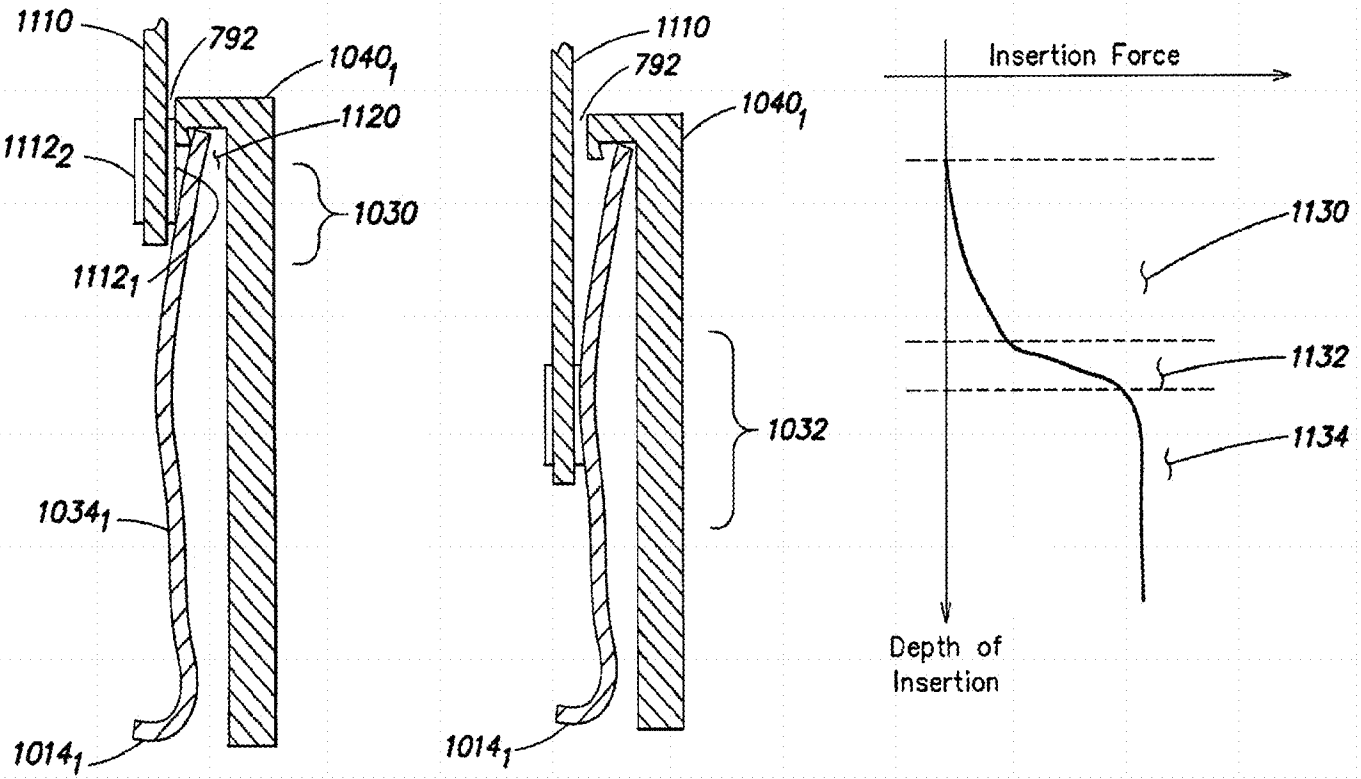
FIG. 9A is a cross sectional view of a portion of the contact of FIG. 8B during a first portion of a mating sequence.
FIG. 9B is a cross sectional view of the portion of the contact of FIG. 9A during a later stage of the mating sequence.
FIG. 9C is a graph showing insertion force of the connector of FIGS. 9A and 9B during a mating sequence.

FIG. 9A shows a portion 1110 of a mating connector being inserted in slot 792. In FIG. 9A, only member $1014_1$ is shown. Embodiments of a contact may be constructed using only one member. Other embodiments may have multiple members per contact. In embodiments in which a contact is formed with multiple members, additional members may operate during a mating sequence in the same way as member $1014_1$. Accordingly, only one member is illustrated for simplicity.

Portion 1110 may be a portion of any suitable connector. For example, portion 1110 may be a forward portion of a wafer 130 (FIG. 1D) or 630 (FIG. 5A). Portion 1110 may contain one or more mating contact portions that engage members, such as member $1014_1$. In the embodiment illustrated, mating contact portions are pads, of which pads $1112_1$ and $1112_2$ are shown. Here, pads $1112_1$ and $1112_2$ form opposing surfaces of one conductive element, though any suitable configuration of mating contact portions may be used.

FIG. 9A illustrates the position of portion 1110 at the start of a mating sequence. As portion 1110 enters slot 792, it contacts distal portion 1030. Because distal portion 1030 is tapered to be relatively thin, it is compliant and therefore easily deflected by force exerted on distal portion 1030 by portion 1110 when portion 1110 is first inserted. In the embodiment shown, distal portion 1030 is initially spaced from wall $1040_1$ by a space 1120, creating a space into which distal portion 1030 may be deflected while still moving freely.

To prevent damage to distal portion 1030 during insertion of portion 1110, walls $1040_1$ and $1040_2$ may have retaining features that prevent the distal ends 1030 of members $1014_1 \ldots 1014_4$ from extending into slot 792, which can cause stubbing when a mating portion of a connector is inserted into slot 792. In the embodiment illustrated, lips $1042_1$ and $1042_2$ (FIG. 8B) adjacent to an opening into slot 792 act as retaining features. However, retaining features of any suitable construction may be used.

FIG. 9B illustrates the position of portion 1110 at a later time in the mating sequence. In the configuration illustrated, portion 1110 has been inserted into slot 792 a sufficient distance that pad $1112_1$ engages arched portion 1032. In this configuration, distal end 1030 of member $1014_1$, has been pressed through space 1120 and presses against a surface that stops its motion. In the embodiment illustrated, that surface is a portion of wall $1040_1$. However, any suitable structure may be used to restrain motion of distal end 1030.

In the embodiment illustrated, distal end 1030 rests in a corner of wall $1040_1$. In this configuration, distal end is restrained from moving away from slot 792. Member $1014_1$ is also restrained from moving along wall $1040_1$ as portion 1110 presses against arched portion 1032. Consequently, as portion 1110 presses against arched portion 1032, member $1014_1$ is placed in compression. Because placing arched portion 1032 in compression requires more force than deflecting distal portion 1030, the insertion force increases as portion 1110 is inserted to the point that it engages arched portion 1032.

The insertion force during such a mating sequence is shown in FIG. 11C. In region 1130, portion 1110 initially makes contact with member $1014_1$, resulting in a relatively low force. Because member $1014_1$ is tapered, the force increases non-linearly as wider, and therefore stiffer, segments of member $1014_1$ are deflected as the insertion distance increases.

Thus, region 1130 indicates a low, but increasing insertion force as portion 1110 is initially inserted. The tapered configuration of member $1014_1$ may be used in connectors for which a low initial insertion force is desired, such as in embodiments in which float is desired. With low initial insertion force, two mating connectors may be easily aligned at the outset of the mating sequence.

As portion 1110 is inserted further, the insertion force increases, as depicted by region 1132. Region 1132 corresponds to the portion 1110 pressing against arched portion 1032. As can be seen, in region 1132 the insertion force increases at a greater rate than in region 1130.

When portion 1110 is inserted in slot 792 until the forward edge reaches the apex of arched portion 1032, further insertion does not further compress arched portion 1032. At that point, the insertion force does not increase, even if portion 1110 is further inserted. However, in the embodiment illustrated, mating surface $1034_1$, (FIG. 8B) presses against surface $1112_1$ with the force illustrated in region 1134. As a result, there is a relatively high contact force, corresponding to the force illustrated in region 1134. This relatively high contact force may retain portion 1110 in place and may provide a good electrical connection between the mating contact portions. However, because this high contact force creates a high insertion force over only a small portion of the insertion sequence, mechanical structures to align mating connectors and generate the required insertion force may be simplified.

FIGS. 9A, 9B and 9C illustrate that contact 900 may be shaped to provide a desired force profile during a mating sequence. By omitting or incorporating a taper or otherwise controlling the dimensions of the distal end 1030, the initial mating force can be controlled. Be controlling the dimensions of a central portion, such as arched portion 1032, as well as the location at which distal end 1030 becomes restrained, the retention force of the contact may be controlled.

Figure 10:
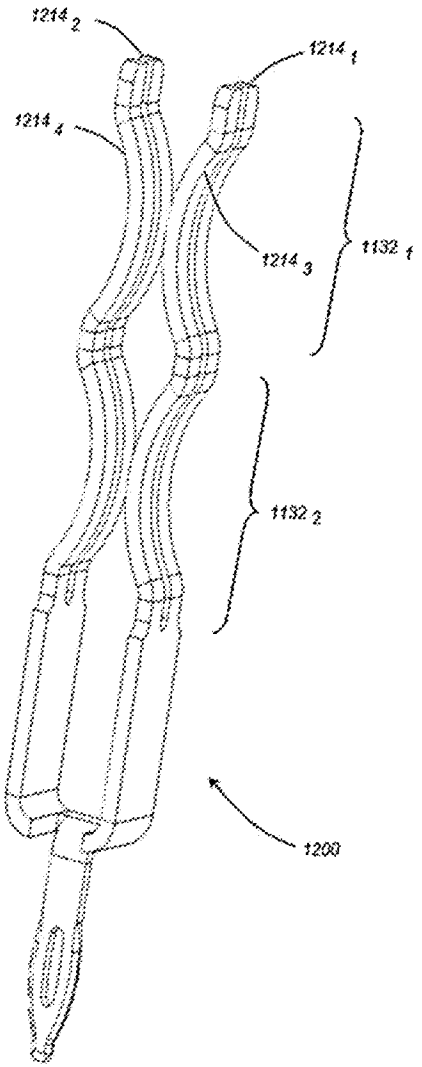
FIG. 10 is a sketch of a contact that may be used in the backplane connector of FIG. 7 according to an alternative embodiment of the invention.

FIG. 10 illustrates an alternative embodiment of a contact 1200 with a different shape to provide a different insertion force profile. Contact 1200, like contact 900 includes four elongated members $1214_1 \ldots 1214_4$. In the embodiment illustrated, each of the each of the elongated members contains two arched portions, $1132_1$ and $1132_2$. Such a configuration may provide two stepped increases in insertion force as a mating connector portion engages contract 1200. The first stepped increase may occur as the mating contact portion is inserted to the point that the leading edge engages the mating arched portion $1132_1$. A second stepped increase may occur as the leading edge engages arched portion $1132_2$. In the embodiment illustrated, each arched portion $1132_1$ and $1132_2$ is approximately the same size such that each step increase in insertion force may be approximately equal. However, the invention is not limited in that regard and any suitable configuration may be used to provided a desired insertion force profile.

Accordingly, the specific configuration of the elongated members of a contact is not a limitation of the invention. For example, though elongated members with rounded arches are illustrated, the invention is not so limited. An arch may be formed with straight segments that join at a defined point.

Figure 11:
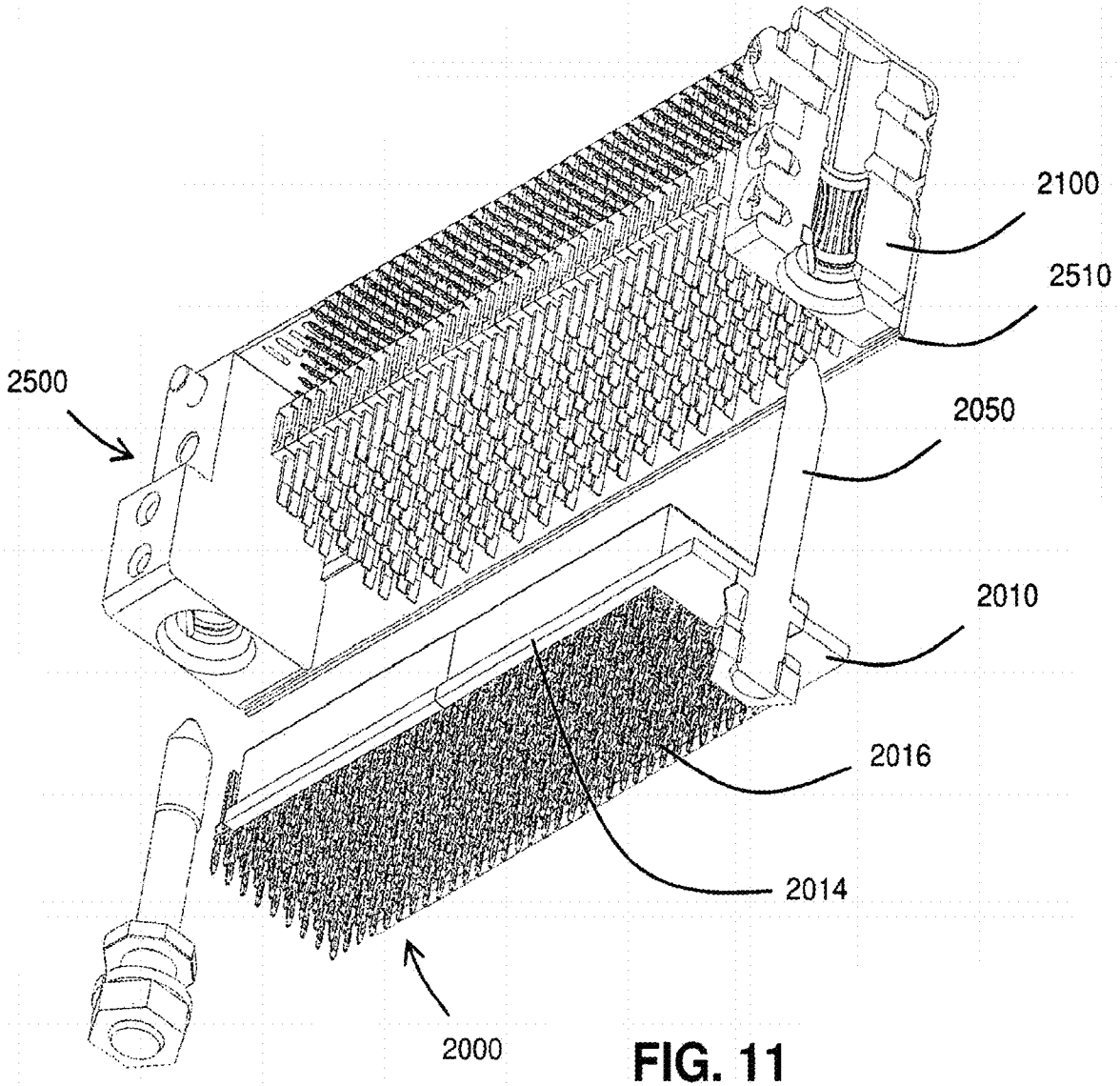
FIG. 11 is a sketch of a board to board interface with two connectors in position to mate.

In another illustrative embodiment of the present invention, FIG. 11 shows an exemplary interface between two printed circuit boards (not shown), such as a backplane and a daughter card. In the embodiment illustrated, conductive members mate within the interface to provide electrical connections between the boards. In addition, the interface incorporates guidance and polarizing features that align the mating conductive members and limit the types of boards that can form electrical connections through the interface, thereby reducing the risk that an incorrect daughter card will be installed in an electronic assembly containing a backplane using an interface according to an embodiment of the invention.

FIG. 11 provides an overall perspective, partially cut away, of a daughter card connector 2500 mating with a backplane connector 2000, with various elements in plain view. In use, daughter card connector 2500 may be mounted to a daughter card or other printed circuit board and backplane connector 2000 may be mounted on a backplane or other printed circuit board. Backplane connector 2000 includes a backplane connector housing 2014 that further contains numerous backplane contact attachment regions, such as cavities 2016, so that signal and ground conductive elements may be inserted in any suitable fashion, an example of which will be described below. These conductive elements may be electrically connected, such as through press fit contact tails illustrated in FIG. 11, to conductive traces in the backplane. Conductive elements in daughter card connector 2500, which are here illustrated to be contained within wafers as described above, may mate with the conductive elements in backplane connector 2000. The conductive elements in daughter card connector 2500 may be connected to conductive elements in a daughter card, completing conductive paths between the backplane and the daughter card with the connectors are mated.

Backplane connector 2000 contains a flange 2010 that includes a keying interface into which a guidance pin 2050 may be inserted. As the daughter card connector 2500 is mated with the backplane connector 2000, the guidance pin 2050 fits into a guidance block 2100, which is attached to the daughter card connector 2500. In various embodiments, the insulative housing may be made out of any suitable material, such as for example, molded plastic.

Figure 12A:
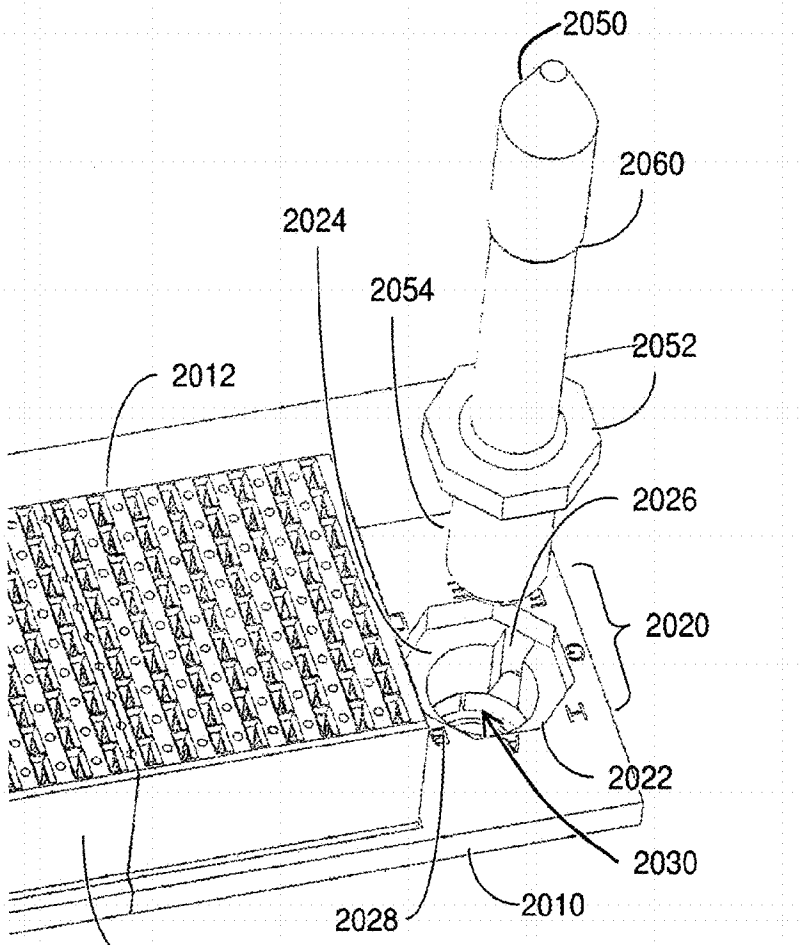
FIG. 12A is a sketch of a keying interface on a backplane connector and a corresponding guidance pin according to an embodiment of the invention.
Figure 12B:
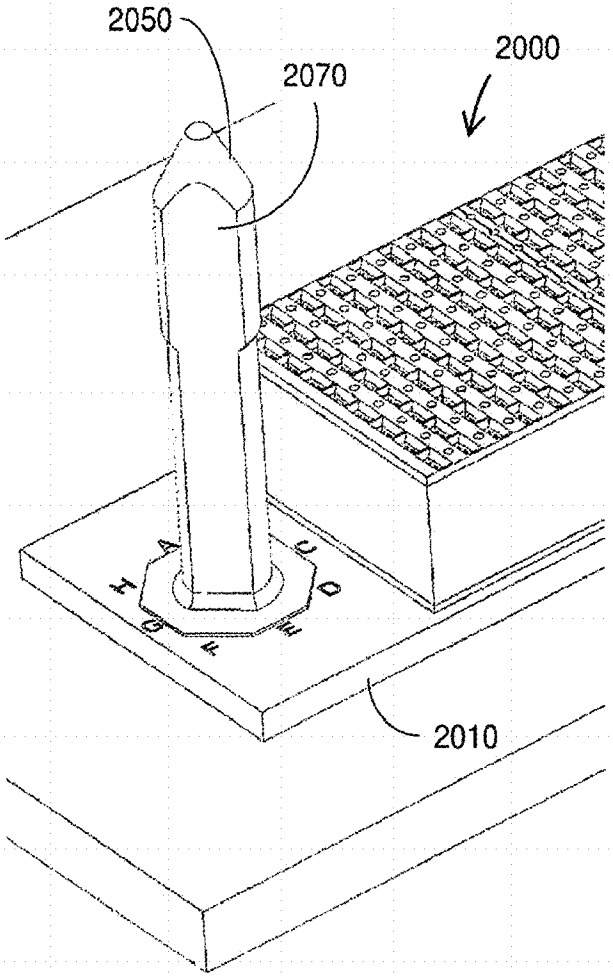
FIG. 12B is a sketch of a keying interface on a backplane connector and a guidance pin placed within the interface according to an embodiment of the invention.

FIGS. 12A and 12B illustrate in greater detail construction and use of a guidance pin 2050 according to an embodiment of the invention. In the embodiment illustrated, guidance pin 2050 provides both a guidance and a polarizing function. In this respect, backplane connector 2000 may provide a keying interface 2020, which facilitates positioning of a guidance pin 2050 relative to conductive contact positions 2012 in backplane connector 2000. Keying interface 2020 may also facilitate positioning of guidance pin 2050 with an appropriate orientation relative to guidance block 2100.

In various embodiments, a flange 2010 may extend from the backplane connector housing 2014, including a keying interface 2020 with an opening 2030, which may allow for the guidance pin 2050 to be appropriately inserted. In some embodiments, the flange 2010 which includes the keying interface 2020 may be integrally molded together with the backplane connector housing 2014.

In FIGS. 12A and 12B, the keying interface 2020 includes an outer hexagonal region 2022 and an inner circular region 2024 that form a profile that complements the profile of guidance pin 2050. As shown in FIG. 12A, the guidance pin 2050 has a circular portion 2054 and a hexagonal portion 2052 in order to fit suitably well into the interface, as depicted in FIG. 12B. A hole is depicted that extends through a backplane to which backplane connector 2000 may be mounted. The base of guidance pin 2050 may extend through this hole and be secured, such as by a nut threaded onto the base of guidance pin 2050. It should be understood, though, that a through hole in the backplane and backplane connector 2000 is not a necessary requirement for the invention and any suitable attachment mechanism may be used.

In some embodiments, a hole through the backplane may have a notched slot 2026. Such a hole may be included to provide an alternative mechanism for positioning guidance pin 2050 as is known in the art. By providing a connector with a flange as illustrated in FIG. 12A, a board with a notched slot 2026 may receive a guidance pin as is known in the art or as illustrated in FIG. 12A.

To provide a polarizing function, guidance pin 2050 has an asymmetrical portion. The guidance pin 2050 may be inserted in a variety of keying orientations, given by the hexagonal feature. It is possible that the guidance pin 2050 be inserted with the asymmetrical portion in a preferred orientation according to how a guidance block 2100 on the daughter card would fit over the pin. For this reason, guidance pin 2050 may include an asymmetrical portion that may be, but is not limited to, a flat portion 2070 as depicted in FIG. 12B. Flat portion 2070 may serve to complement a guidance block profile, as will be described later, to ensure that only daughter card connectors configured with the same polarization as is provided by guidance pin 2050 may mate with a backplane connector 2000. It should be understood that, though a partially flat guidance pin is illustrated, the profile of guidance pin 2050 as it complements the profile of the guidance block 2100 may be of any suitable shape.

Labels 2028 may also be included on the flange 2010 adjacent the keying interface 2020, for identifying proper orientations within the interface guidance pin 2050. Users may change keying positions by removing the guidance pin 2050 and then repositioning the pin in the keying interface 2020 with a different one of the proper orientations. The hexagonal shape of keying interface 2020 and hexagonal region 2022 provide eight possible orientations of guidance pin 2050. It should be understood that any suitable keying interface profile may be used along with an appropriately shaped guidance pin 2050 as the hexagonal or circular shapes are not intended to be limiting features.

Figure 13B:
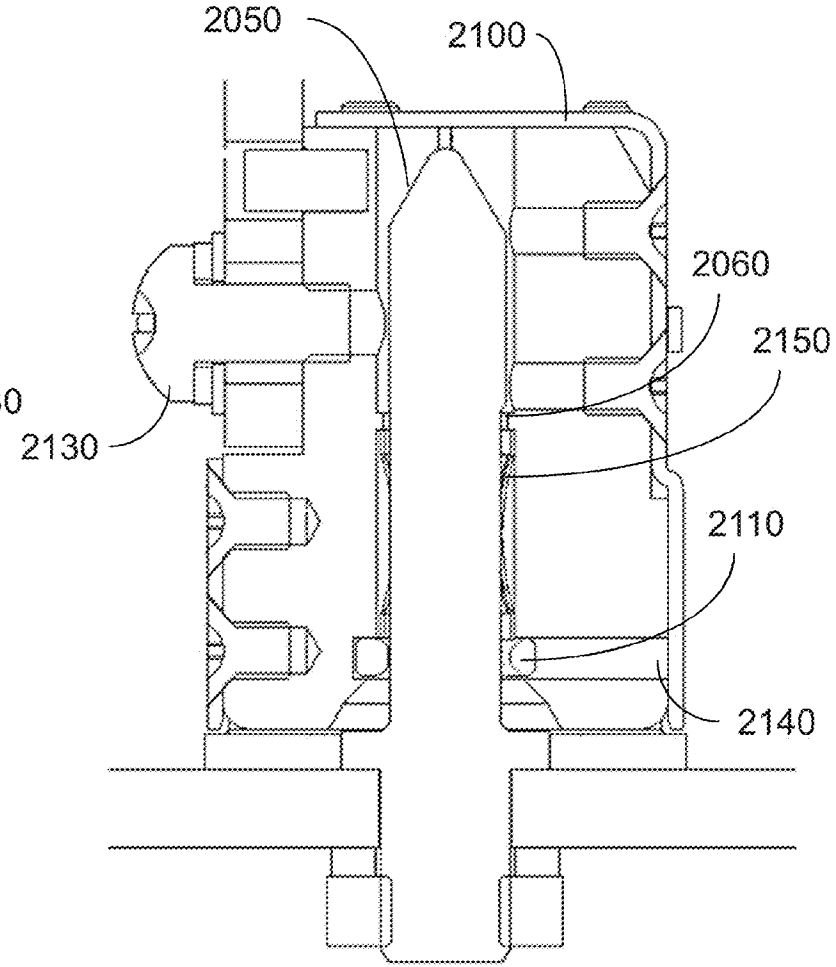
FIG. 13B is a cross-sectional view of a guidance pin mated to a guidance block according to an embodiment of the invention.
Figure 13A:
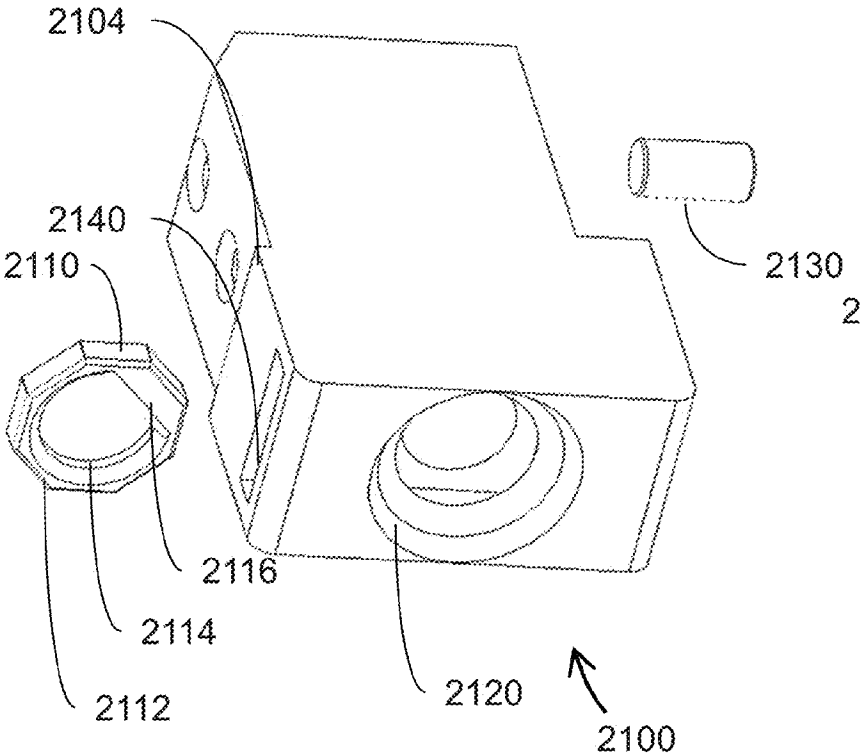
FIG. 13A is a sketch of a guidance block and a corresponding orientation member according to an embodiment of the invention.

FIG. 13A depicts guidance block 2100, which may be incorporated into a daughter card connector and may be mounted to a daughter card or other suitable printed circuit board. Fastening mechanisms 2130 may be used in order to secure the guidance block 2100 to the daughter card. Fastening mechanism 2130 may be a screw or other suitable mechanism.

Guidance block 2100 is designed to receive a guidance pin 2050 so that a daughter card connector and a backplane connector may be aligned for proper mating. The guidance block 2100 may include a tapered region 2120 that can allow for gathering of the guidance pin 2050 into a hole in block 2100. An orientation member 2110 may be used to ensure that only a guidance pin 2050 with a suitable orientation is received into the block 2100. In some embodiments, a stepped surface 2104 may be included on the guidance block 2100 so as to receive a protective covering.

Guidance pin 2050 may be formed out of any appropriate material. In some embodiments, the guidance pin 2050 may be molded plastic, metal, or any other rigid material. In other embodiments, the guidance pin 2050 may include a metal post, overmolded with plastic or other suitable coating.

Orientation member 2110 may be mounted in one or more possible orientations, preferably corresponding to the number of possible orientations of guidance pin 2050. In the embodiment shown in FIG. 13A, the orientation member 2110 is shaped as a ring that has an outer hexagonal portion 2112, an inner circular portion 2114, and a flat portion 2116. The orientation member 2110 may be inserted within the guidance block 2100 through a slot 2140, allowing for the orientation member 2110 to be placed around a hole in the block into which guidance pin 2050 may be inserted. Slot 2140 may also appropriately constrain the ring in a proper orientation. In various embodiments, slot 2140 has parallel walls to suitably constrain the orientation member 2110. Member 2110 may be placed in any suitable orientation, in this particular embodiment, according to how the flat portion 2116 is positioned.

Because block 2100 may be attached to a daughter card connector in order to facilitate connection between a daughter card and a backplane, when the daughter card connector is mated with the backplane connector, the flat portion 2070 of the guidance pin 2050 aligns with the flat portion 2116 of the orientation member 2110 according to the desired keying position. In this orientation, guidance pin 2050 may pass through orientation member 2110. In other orientations, guidance pin 2050 does not fit through orientation member 2110.

FIG. 13B shows one cross-section embodiment of a guidance pin 2050 inserted within guidance block 2100. To facilitate float, an undercut 2060 may be incorporated in the guidance pin profile so that appropriate float may occur once the connectors are mated. In one aspect, either or both of the guidance pin 2050 and guidance block 2100 has an undercut region such as undercut regions 2060 or 2102, shown with more emphasis in FIG. 13C, that allows for movement or "float" of the pin shaft 2058 within the guidance block 2100 once the pin and block are mated. This float may be allowed in one direction orthogonal to the shaft 2058 of guidance pin 2050. In the embodiment shown, the undercut region 2102 within guidance block 2100 may be present along one cross-section, yet in a transverse cross-section, a constraining wall may take the place of the undercut region, not allowing for float in a perpendicular direction.

In some embodiments, translation in one direction, as permitted from the undercut regions 2060 and 2102, allows for float of the printed circuit board and the backplane to occur in a direction in which compliant contacts within backplane connector 2000 can accommodate float, but blocks relative movement in a direction that could overstress and therefore damage compliant contacts. As discussed previously, float could be used with rail locks for ruggedization or for pressing of components against a cold wall. Though, float may be provided for any other purpose.

Figure 13D:
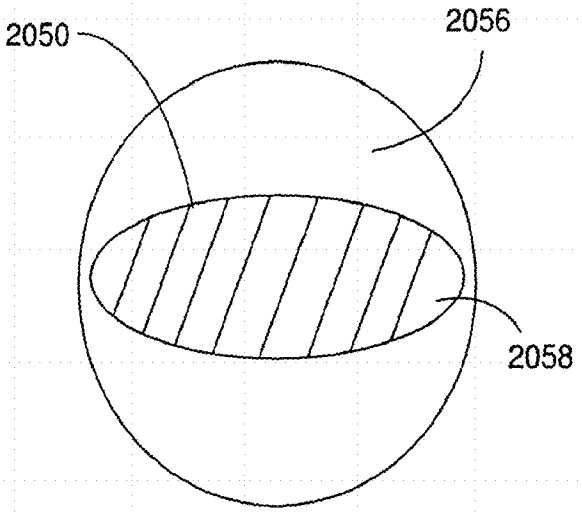
FIG. 13D is a cross-sectional view of a guidance pin showing an elliptical shaft according to an embodiment of the invention.
Figure 13C:
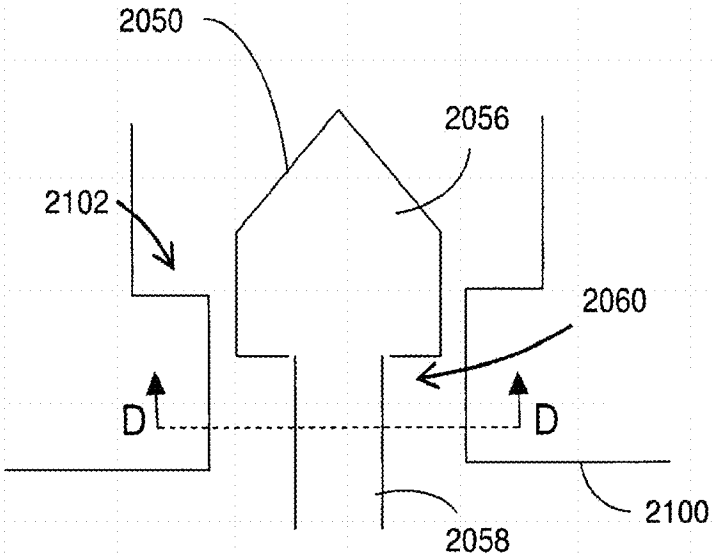
FIG. 13C is a cross-sectional view of a guidance pin and a guidance block showing undercuts according to an embodiment of the invention.

In some embodiments, the guidance pin 2050 may have a substantially elliptical cross-section, as depicted in FIG. 13D, where translation may occur in a first direction parallel to the backplane substantially more than translation in a second direction which is also parallel to the backplane, but perpendicular to the first direction. In further embodiments, the undercut region 2102 within guidance block 2100 is substantially elliptical, allowing for movement laterally in the first direction parallel to the backplane substantially more than in the second direction which is perpendicular to the first direction, yet movement in the second direction is not completely constrained. FIG. 13D shows an example of an elliptical pin shaft 2058 and a circular upper tip 2056, which allows float to occur once the tip 2056 moves into an opening 2102 where shaft 2058 provides space for translation to be permitted.

In various embodiments, a safety ground spring is included within the block 2100 in order to provide grounding of the pin 2050 as it is installed. In this respect, risk of damage to a printed circuit board from electrostatic discharge (ESD) may be reduced. The spring and pin may be connected to grounds on the daughter board and backplane, making a path to dissipate static electricity when mated.

Guidance block 2100 may be formed of any suitable material. In some embodiments, the guidance block 2100 may be molded plastic. In other embodiments, the orientation member 2110 may be formed out of the same material as the guidance block 2110 or may be a different material than the guidance block 2110, such as metal or another rigid material.

Figures 14A, 14B, 14C, 14D:
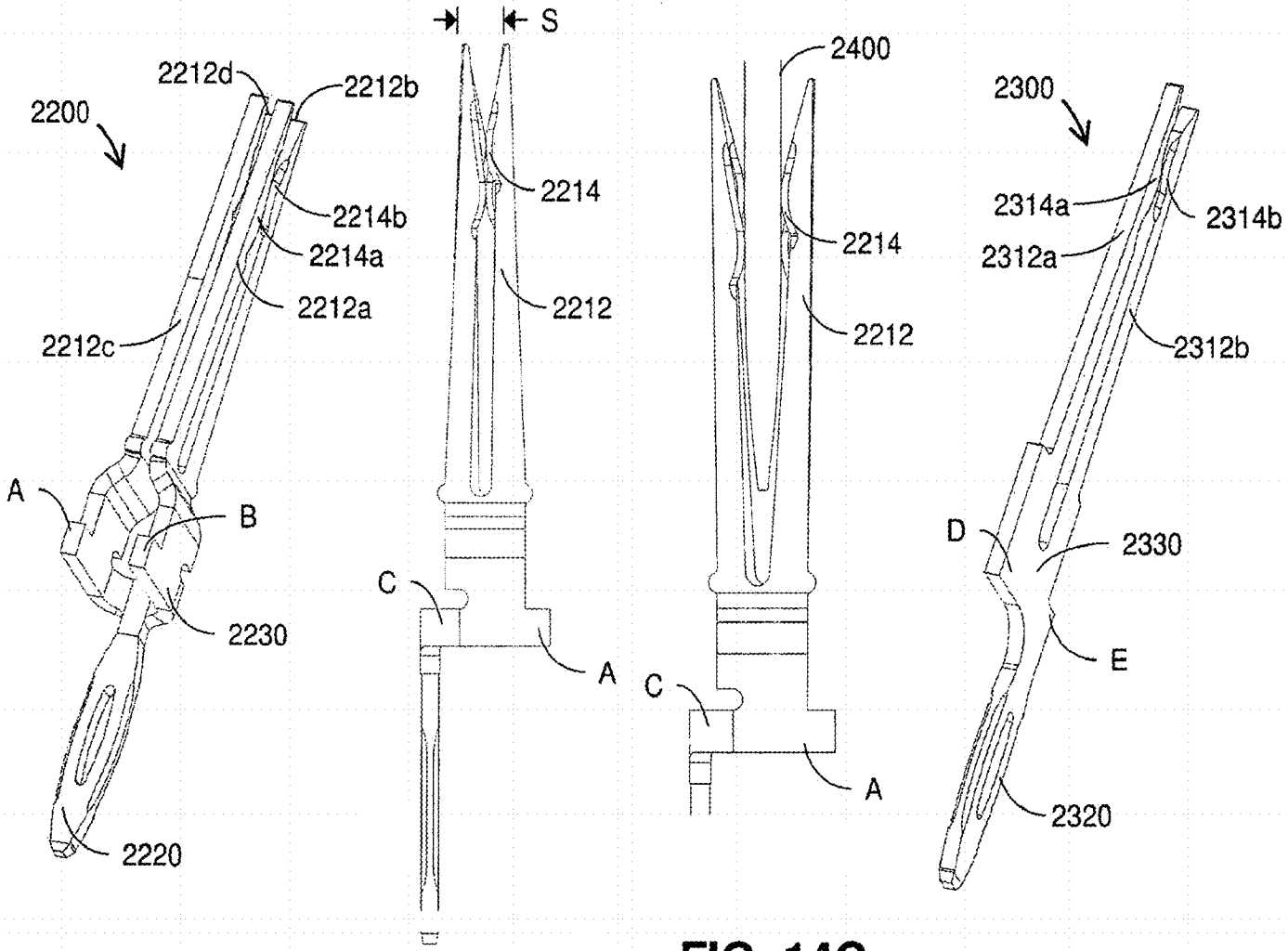
FIG. 14A is a perspective sketch of a conductive element used as a signal contact according to an embodiment of the invention.
FIG. 14B is a side view of a conductive element used as a signal contact according to an embodiment of the invention.
FIG. 14C is a side view of a conductive element used as a signal contact connected to a mating contact according to an embodiment of the invention.
FIG. 14D is a perspective sketch of a conductive element used as a ground contact according to an embodiment of the invention.

Another embodiment of backplane contacts are shown in FIGS. 14A-14D. FIGS. 14A-14C illustrate different viewpoints for a conductive element 2200 that may be used as a signal conductor in a backplane connector according to an embodiment of the invention. Conductive element 2200 includes a contact tail 2220, which may be shaped in any suitable manner, and is shown to be shaped as an eye of a needle, as depicted in previous embodiments.

In the embodiment illustrated, conductive element 2200 includes four beams 2212*a*, 2212*b*, 2212*c*, and 2212*d*, shown in FIG. 14A, with each of the beams having a corresponding contact surface, 2214*a* and 2214*b* being visible in the illustration. In this embodiment, the beams are positioned in pairs, with beams of each pair opposing each other and separated by a distance S.

A mating conductive contact may be received between the beams of each pair. In FIG. 14C, conductive element 2200 is shown receiving a mating contact 2400 from a daughter card so that beams 2212*a* and 2212*c* press on one side of the mating contact 2400 and beams 2212*b* and 2212*d* press on an opposing side of the mating contact 2400. The beams may also bend slightly so that the opposing distance between the beams becomes greater than the original distance S. In the embodiment illustrated, the amount of deflection of the beams represents a normal operating condition and the beams maintain their compliance when deflected as illustrated in FIG. 14C.

The illustrated embodiment also incorporates a U-shaped base 2230 where the beams 2212 converge. Base 2230 includes tabs A, B, and C to be inserted onto ledges within a connector housing. Tabs A, B, and C on base 2230 may be sized and positioned to fit snugly within a slot or other suitable structure within a connector housing.

In this embodiment, conductive element 2200 is used as a signal contact, but may be used for other purposes as well. When used for other purposes, a conductive element may have the same or a different shape. For example, any appropriate number of beams and corresponding contacts may be used for conductive element 2200. Regardless of the shape, conductive elements may be manufactured through a process in which elements are stamped from a single conductive sheet and formed as illustrated. Though, any suitable manufacturing technique may be used.

In various embodiments, the points of contact on surfaces 2214 and 2314 are staggered along the length of beams

2212*a* . . . 2212*d*, which may allow for the contacts to be formed with a spacing S that is less than would be possible were the points of contact not staggered. In FIGS. 14A-14D, contact surfaces may be shaped as protrusions from the beams that have varying shapes as well as locations on the beam from which they protrude. In addition, incorporating beams with contact points a different distance from the based on the contact, providing different effective lengths to the beams. Different lengths may reduce overall insertion force as well as reducing vibration harmonics, for example, because different beams vibrate at different harmonics. Different pressure values and locations on contact surfaces of contact beams may also provide for added survival tolerance, because if a passivation layer, such as a gold coating, on mating contact 2400 wears off adjacent one of the points of contact, the others could still make effective electrical contact.

FIG. 14D shows another embodiment of a conductive element 2300 that is used as a ground contact, but may also be used for other types of electrical contact. In this embodiment, conductive element 2300 includes two beams 2312*a* and 2312*b*, each of the beams having corresponding contact surfaces 2214*a* and 2214*b*. A base 2330 and contact tail 2320 are also included in the conductive element 2300 and connection occurs with a mating contact 2400 in a fashion similar to that described for conductive element 2200, except with two contact points instead of four. Of course, similar to that described above, any appropriate number of beams and corresponding contacts may be used for conductive element 2300. Although not meant to be limiting, when mating contact surfaces of signal and ground contacts are aligned, the contact tail 2320 for the ground contact element is perpendicular to the contact tail 2220 for the signal contact element.

Figure 16:
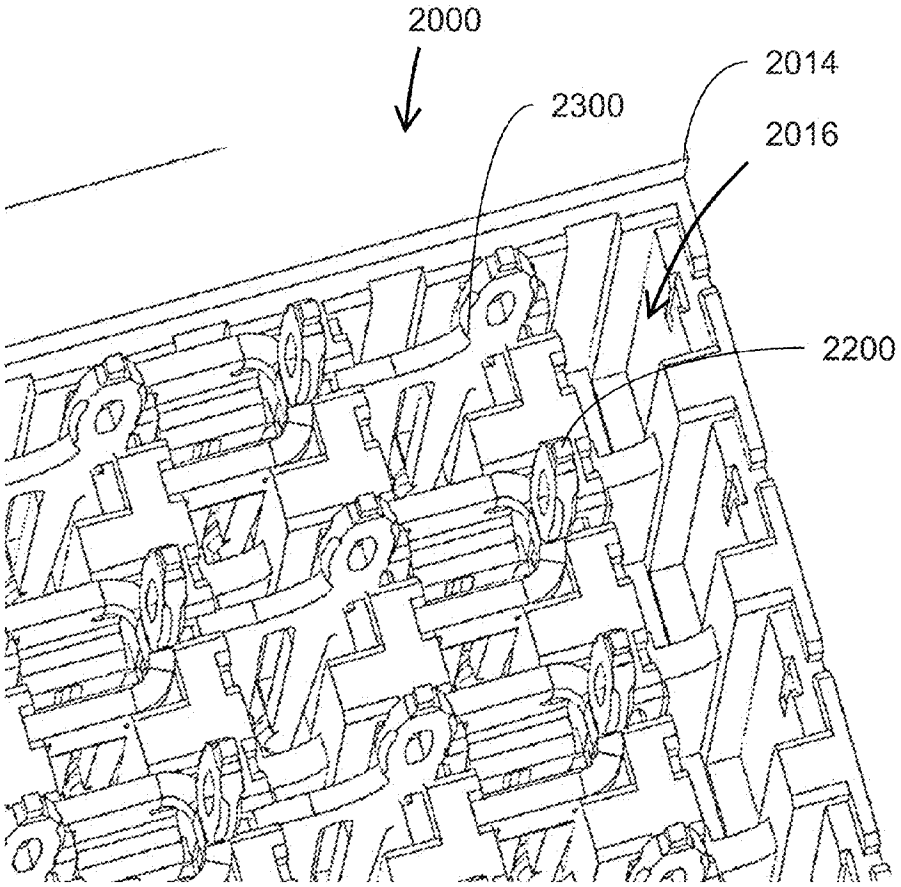
FIG. 16 is a sketch of backplane connector with conductive elements inserted into receiving slots according to an embodiment of the invention.

In another aspect of the present invention, a pattern of signal and ground contacts in the backplane connector 2000 is not required to be set prior to manufacture of the electrical contact assembly. In this regard, modularity of signal and ground contacts may be provided as either type of contact may be placed within the backplane connector housing 2014 in any desired pattern. FIG. 16 shows the underside of backplane connector 2000 where the connector housing 2014 includes signal conductive elements 2200 and ground conductive elements 2300 that may be positioned in a programmable fashion within attachment regions 2016 that are structurally configured to receive any suitable type of conductive contact.

In other embodiments, some c attachment regions 2016 may be left without a conductive element placed within them. In further embodiments, signal conductive elements 2200 and ground conductive elements 2300 may be placed in the connector slots 2016 in an alternating pattern. In yet other embodiments, signal conductive elements 2200 and ground conductive elements 2300 may be paired together and placed in the connector slots 2016 in any suitable pattern including an alternating pattern. Indeed, signal conductive elements 2200 and ground conductive elements 2300 may be placed in the connector slots 2016 in any pattern that is desired.

Figure 17:
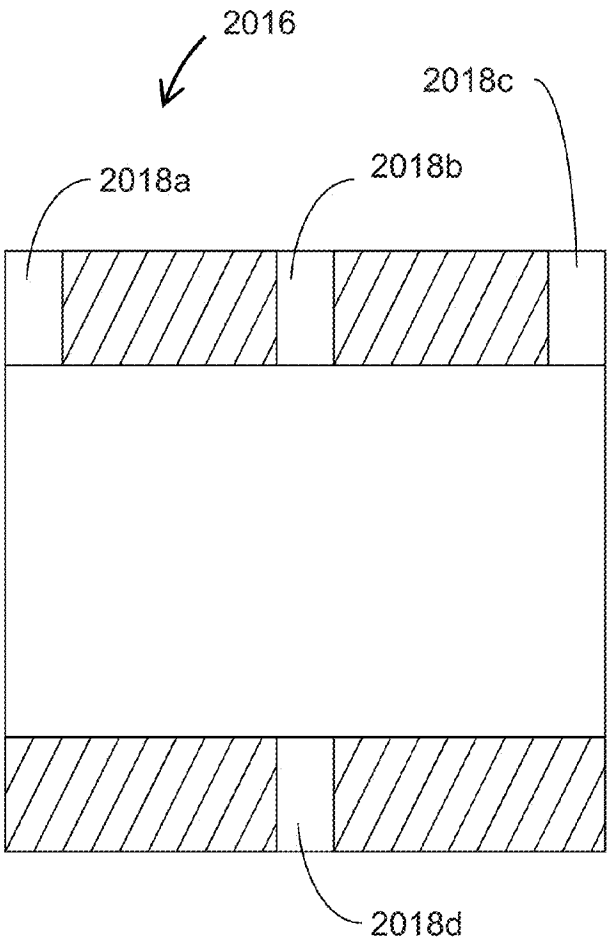
FIG. 17 is a sketch of a backplane connector slot according to an embodiment of the invention.

FIG. 17 depicts an attachment region. Such attachment regions may be positioned within the housing in rows and/or columns. Each attachment region within the backplane connector is designed to receive either a signal conductive element 2200 or a ground conductive element 2300. In the embodiment depicted, ledges 2018*a*, 2018*b*, 2018*c*, and 2018*d* may facilitate insertion of either a signal or ground conductive element into the attachment region.

As described previously in FIGS. 14A-14D, signal contact tails 2220 may have a substantially flat portion and ground contact tails may also have a substantially flat portion. Flat portions may be used to attach contacts to the housing. When the signal and ground contacts are positioned such that a mating contact may contact the conductive beams in a similar fashion, i.e. the conductive beams face in substantially the same direction, the signal and ground contacts are said to be of a same orientation. In some embodiments, when a signal contact and a ground contact are of the same orientation, the flat portion of the signal contact tail is substantially perpendicular to the flat portion of the ground contact. Each attachment region may accept an attachment portion of either a signal or ground. In this respect, when conductive element 2220 is inserted into an attachment region, tab A of the conductive element 2220 may be placed onto ledge 2018*a* of a connector slot 2016 and opposing tab B may be placed onto ledge 2018*c*. Similarly, tab C of conductive element 2220 may be placed onto ledge 2018*d*. When conductive element 2320 is inserted into an attachment region, tab D may be placed onto ledge 2018*b* of connector slot 2016 and tab E may be placed onto ledge 2018*d*.

Figure 15:
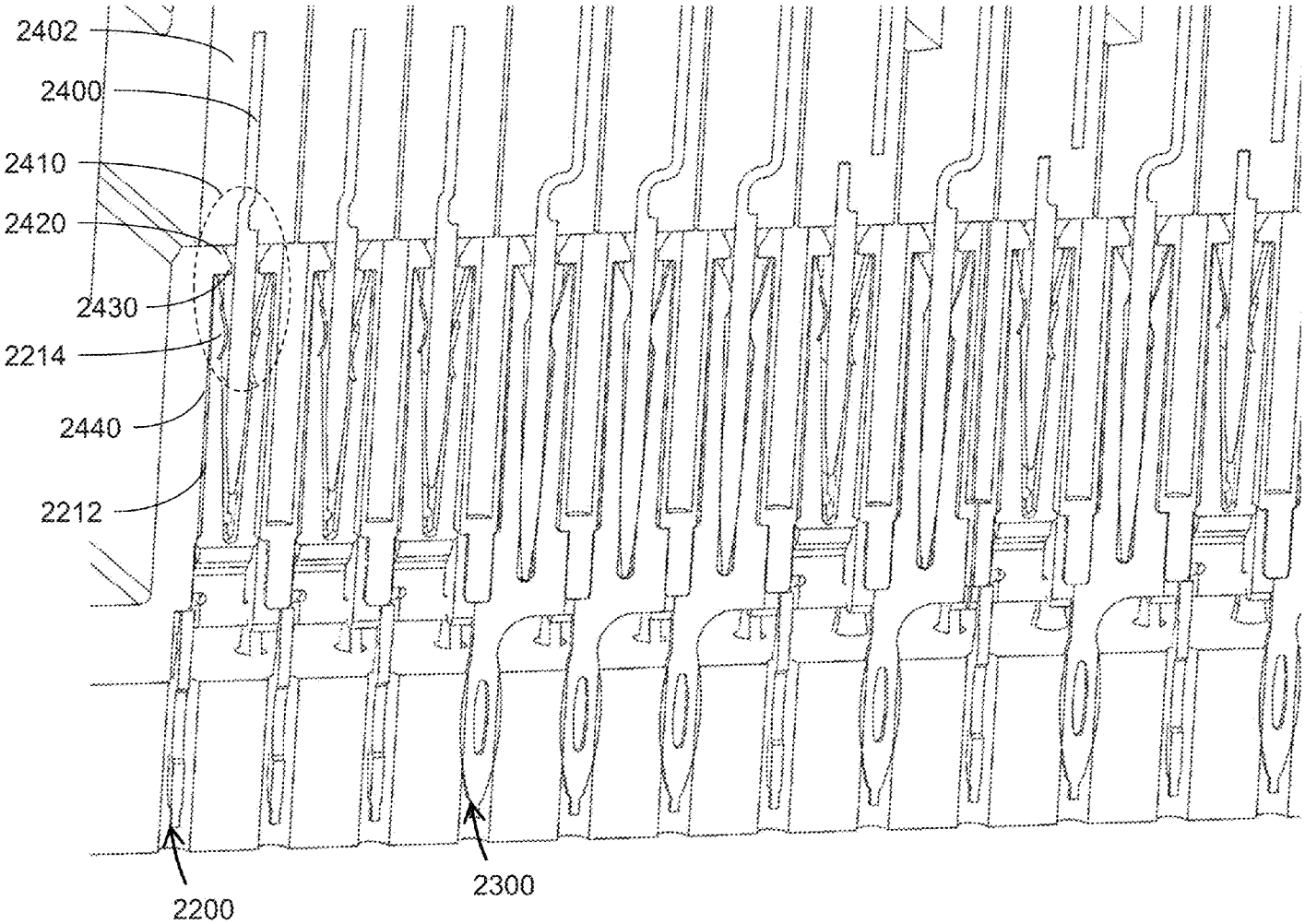
FIG. 15 is a sketch of a printed circuit board mated with a backplane connector showing a connection region according to an embodiment of the invention.

In another illustrative embodiment, shown in FIG. 15, when the daughter card connector 2500 is mated to the backplane connector 2000, features in the leading face of the backplane connector housing 2014 may protect elements of the backplane conductive elements from damage. For example, without a restraining feature according to embodiments of the invention, a slightly bent blade in the mating contact 2400 may improperly contact components in the backplane when the daughter card connector 2500 is mated, causing the compliant members of the conductive elements to be bent beyond their yield points. Other errors during operation could similarly deflect the compliant members beyond their yield points. However, according to embodiment of the invention, side walls 2440 of the housing 2014 may be positioned to provide a hard stop in preventing backplane contacts 2200 and/or 2300 from being over bent beyond their yield points.

In the embodiment depicted, mating contact 2400, housed in daughter card housing 2402, may be inserted into the backplane connector housing 2014 and into a connection region 2410 that is individually suited for a mating contact 2400 to establish a connection with a conductive element 2200 or 2300. In some embodiments, each connection region 2410 may have a tapered region 2420 which may be included at the entrance of the connection region 2410 in order to facilitate gathering of the mating contact 2400 into the connection region 2410. Mating contact 2400 may move through tapered region 2420 and pass an overhanging edge 2430 that provides space for the end of a conductive beam of a conductive element 2200 or 2300 to be situated. When electrical contact is established as the front face of daughter card housing 2402 is pressed against the backplane connector housing 2014 and mating contact 2400 is in contact with a corresponding conductive element 2200 or 2300, side wall 2440 may provide support for beams of the conductive element so as not to excessively yield. In this respect, conductive beams may have a deformation limit for yielding and the side wall 2440 may be placed in a position such that the deformation limit of the conductive beams would not be reached. In this regard, once a conductive component is pushed beyond the deformation limit, the component would not spring back to its original position. Such a yield stop mechanism may be especially helpful when there are misaligned pieces which would likely cause beams to deflect beyond their yield limits when a component of a daughter card connector is misaligned with respect to the backplane connector upon mating. Another situation where a yield stop mechanism may be useful is when after mating, boards may, at times, be pushed in one direction or another which could give rise to over-yielding of beams. In this regard, a stop mechanism may be employed to limit overall yield of conductive beams, prolonging functionality of the connective components.

Figure 18:
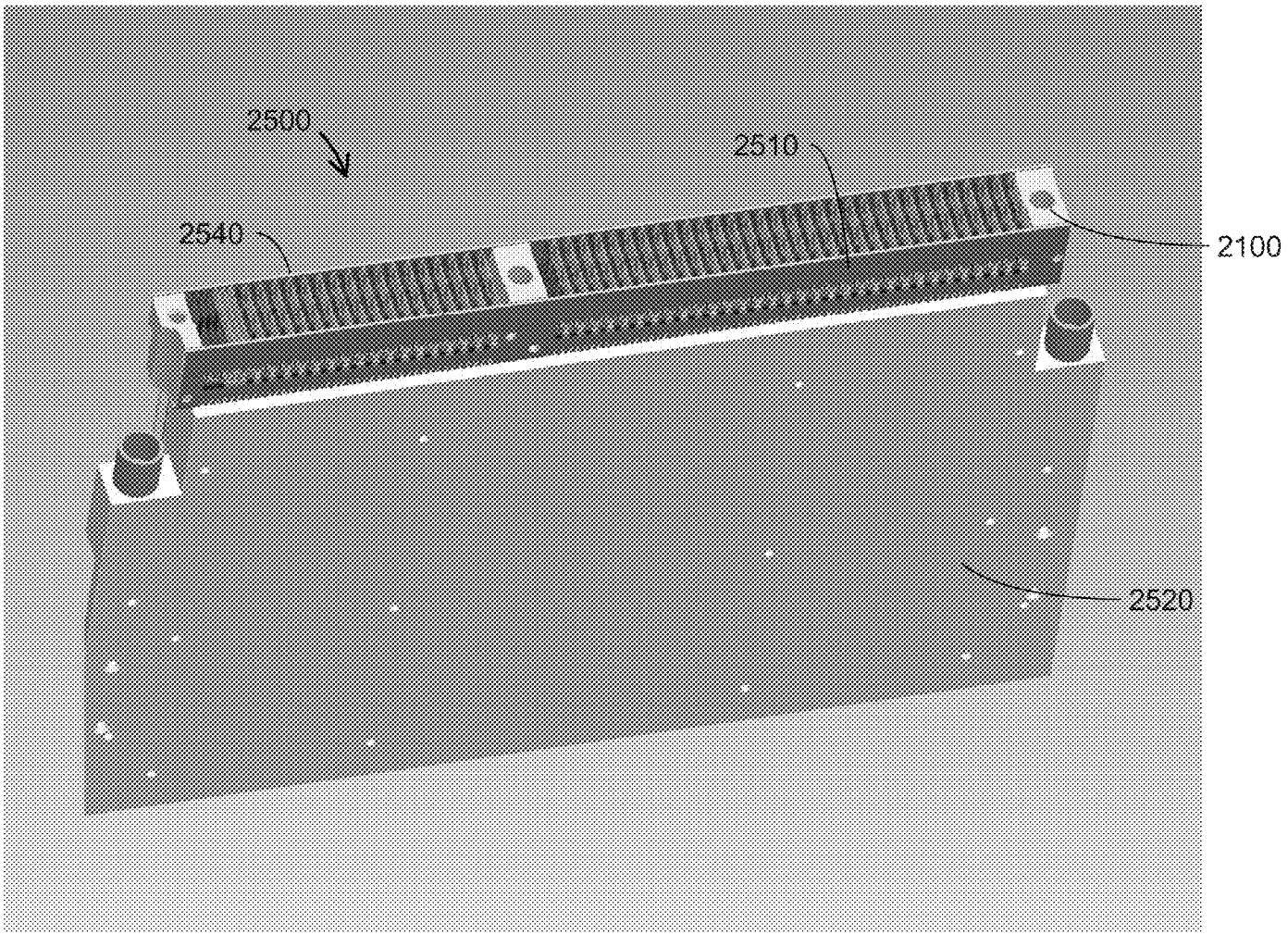
FIG. 18 is a perspective view of a cover attachment on a printed circuit board according to an embodiment of the invention.

FIG. 18 shows an illustrative embodiment of a daughter card assembly with a connector 2500, including a guidance block 2100 for receiving a guidance pin so that connection points from the backplane connector 2000 may align well with connection points from the daughter card connector 2500. In this embodiment, a stiffener 2510 is attached to the connection region 2540 and the guidance block 2100 of the daughter card connector 2500. The stiffener 2510 may be electrically connected to ground, providing for added protection and stiffness. In addition, a cover attachment 2520 may also be provided over the printed circuit board, giving rise to even more protection and stiffness for the daughter card. In this regard, cover attachment 2520 and/or stiffener 2510 may be received by guidance block 2100 in any suitable manner.

Figure 20:
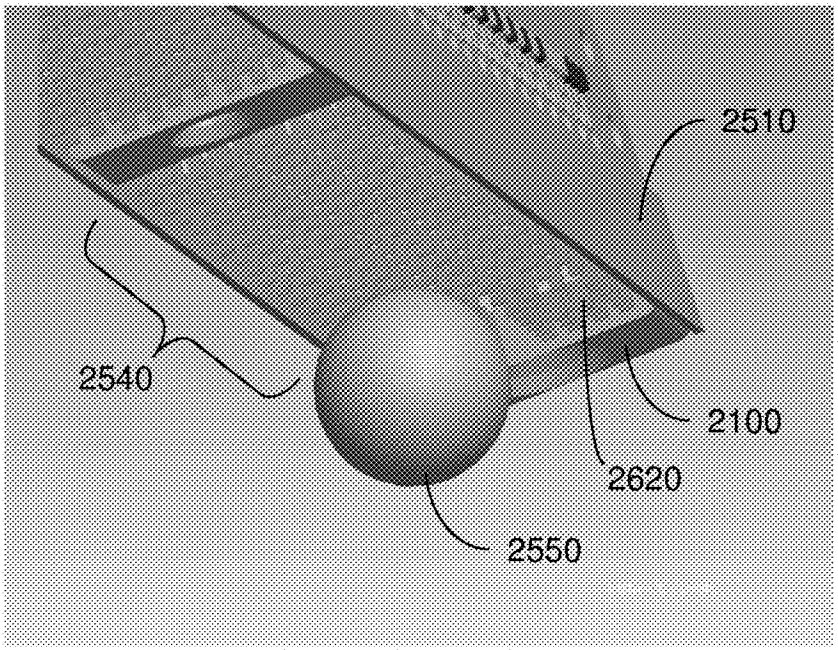
FIG. 20 is a perspective view of a printed circuit board with a discharge test element according to an embodiment of the invention.
Figure 19:
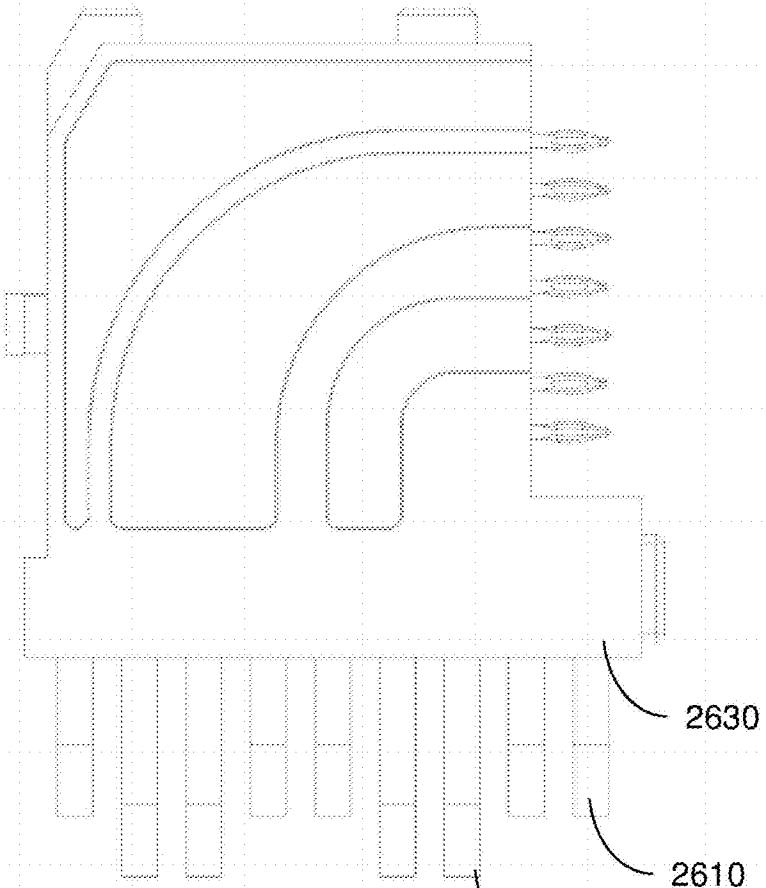
FIG. 19 is a side view of a wafer with long ground contacts and short signal contacts according to an embodiment of the invention.

FIGS. 19 and 20 show another aspect of the present invention that aids in protection from ESD damage. In different embodiments illustrated herein, signal contacts may be shielded by ground contacts that are longer than signal contacts from undesirable electrostatic charge built up on objects in the vicinity of daughter card connector 2500, providing a method for ESD protection. As illustrated in FIG. 19, a wafer 2600, which may be used in daughter card connector 2500, includes a wafer housing 2630 and ground contacts 2620 that are longer than signal contacts 2610. In this respect, the connection region of the daughter card may be protected from an object that may carry unwanted electrostatic charge and may incidentally come into contact with the surface of the daughter card connector.

FIG. 20 shows a daughter card connector 2500 with a stiffener 2510 and guidance block 2100 that are coming into contact with a discharge test element 2550. As the test element 2550 comes close to or into contact with the long ground contacts 2620 that protrude out from the connection region 2540, the signal contacts underneath are protected from any ESD occurrence. In some embodiments, the stiffener 2510 may be connected to the ground contacts. This connection may be through conductive members within daughter card connector 2500 or through a printed circuit board to which the connector is attached.

In various geometrical aspects, the height difference and spacing (centerline and edge to edge spacing) between ground and signal contacts may be of any suitable range that provides ESD protection for the signal conductors. In some embodiments, the height difference between the ground and signal contacts may be between approximately 0.02 inches and approximately 0.15 inches. In other embodiments the height difference between the ground and signal contacts may be approximately 0.08 inches. In different embodiments, the centerline spacing between ground and signal contacts may be between approximately 0.02 inches and approximately 0.15 inches. In further embodiments, the centerline spacing between ground and signal contacts may be approximately 0.07 inches. In this regard, the ratio of the height difference between ground and signal contacts and the average centerline to centerline spacing between signal and ground contacts may range from approximately 0.5 to approximately 2.0.

In other aspects, the width of the ground contact blades may be of any appropriate distance. In various embodiments, the width of the ground contact blades may be between approximately 0.02 inches and approximately 0.15 inches. In yet other embodiments, the width of the ground contact blades may be approximately 0.06 inches. Furthermore, the average edge to edge spacing between signal and ground contacts may also be of suitable distance. In some embodiments, the average edge to edge spacing between signal and ground contacts may be between approximately 0.02 inches and approximately 0.15 inches. In other embodiments, the average edge to edge spacing between signal and ground contacts may be approximately 0.02 inches.

While particular embodiments have been chosen to illustrate the invention, it will be understood by those skilled in the art that various changes and modifications can be made therein without departing from the scope of the invention as defined in the appended claims.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. As one example, different features were discussed above in connection with different embodiments of the invention. These features may be used alone or in combination. Such alterations, modifications, and improvements are intended to be part of this disclosure, and are intended to be within the spirit and scope of the invention. Accordingly, the foregoing description and drawings are by way of example only.

What is claimed is:

1. An electrical connector, comprising:

a plurality of wafers arranged in a side-by-side configuration, each of the plurality of wafers comprising:

a plurality of conductive elements, each of the plurality of conductive elements comprising a mating contact portion, a contact tail and an intermediate portion connecting the mating contact portion and the contact tail, the plurality of conductive elements being disposed in a line;

a first plurality of conductive, concave segments disposed on a first side of the line; and a second plurality of conductive, concave segments disposed on a second side of the line, the first plurality of conductive, concave segments and the second plurality of conductive, concave segments cooperating to form a plurality of conductive channels at least partially enclosing the plurality of conductive elements.

2. The connector of claim 1, wherein the plurality of conductive channels circumscribe the intermediate portions of the plurality of conductive elements.

3. The connector of claim 1, further comprising insulative material that circumscribes at least one conductive element.

4. The connector of claim 3, wherein the insulative material substantially fills a space defined by a first conductive, concave segment of the first plurality of conductive, concave segments and a second conductive, concave segment of the second plurality of conductive, concave segments.

5. The connector of claim 1, further comprising a housing holding the first plurality of conductive, concave segments and the second plurality of conductive, concave segments in place.

6. The connector of claim 5, wherein the insulative housing is molded over the first plurality of conductive, concave segments and the second plurality of conductive, concave segments.

7. The connector of claim 1, wherein each of the plurality of conductive channels encloses a single conductive element of the plurality of conductive elements.

8. The connector of claim 1, wherein the plurality of conductive elements comprise signal contact elements.

9. The connector of claim 1, wherein the first plurality of conductive, concave segments are integrally coupled to at least one contact tail adapted for engagement with a printed circuit board.

10. The connector of claim 1, wherein the first plurality of conductive, concave segments are integrally formed from a sheet of metal.

11. The connector of claim 1, wherein:

the connector further comprises a support member; and the plurality of wafers are attached to the support member.

12. An electrical connector, comprising:

a support member;

a plurality of subassemblies attached to the support member, each of the subassemblies comprising:

a plurality of signal conductors;

a plurality of concave conductive elements positioned to form a plurality of conductive channels at least partially enclosing the plurality of signal conductors; and an insulative housing molded over the plurality of concave conductive elements.

13. The connector of claim 12, further comprising insulative material surrounding the signal conductors of the plurality of signal conductors.

14. The connector of claim 12, wherein each of the conductive channels circumscribes a single signal conductor of the plurality of signal conductors.

15. The connector of claim 12, wherein:

each of the plurality of signal conductors comprises a contact terminal configured for attachment to a printed circuit board; and the contact terminals extend from the plurality of conductive channels.

16. The connector of claim 12, further comprising insulative material disposed within the plurality of conductive channels.

17. The connector of claim 12, wherein the plurality of concave conductive elements are integrally formed with a contact terminal configured for attachment to a printed circuit board.

18. A right-angle electrical connector, comprising:

a support member;

a plurality of subassemblies attached to the support member, each of the plurality of subassemblies comprising:

a plurality of signal conductors; and a plurality of concave conductive elements positioned such that cooperating ones of the plurality of concave conductive elements form a plurality of conductive channels at least partially enclosing the plurality of signal conductors, the plurality of conductive channels bending through an angle of 90 degrees.

19. The right angle electrical connector of claim 18, further comprising:

an insulative housing molded over the plurality of concave conductive elements.

20. The right angle electrical connector of claim 18, wherein the plurality of concave conductive elements are integrally formed with press-fit terminals.

* * * * *